US008116667B2

(12) United States Patent
Ozaki et al.

(10) Patent No.: US 8,116,667 B2
(45) Date of Patent: Feb. 14, 2012

(54) DEVELOPING DEVICE AND IMAGE FORMING APPARATUS

(75) Inventors: Yoshifumi Ozaki, Kanagawa (JP); Akemi Murakami, Kanagawa (JP); Wataru Suzuki, Kanagawa (JP); Tatsuo Okuno, Kanagawa (JP); Shiro Suzuki, Kanagawa (JP); Akihiko Noda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 3 days.

(21) Appl. No.: 12/858,811

(22) Filed: Aug. 18, 2010

(65) Prior Publication Data

US 2011/0236077 A1 Sep. 29, 2011

(30) Foreign Application Priority Data

Mar. 23, 2010 (JP) ..... 2010-066480

(51) Int. Cl.
*G03G 15/08* (2006.01)

(52) U.S. Cl. ..... 399/266

(58) Field of Classification Search ..... 399/266, 399/53, 119, 101, 222, 234, 235, 239, 252–265, 399/267–295; 355/247, 265
See application file for complete search history.

(56) References Cited

U.S. PATENT DOCUMENTS

| | | | | |
|---|---|---|---|---|
| 4,431,296 | A * | 2/1984 | Haneda et al. | 399/266 |
| 4,868,600 | A * | 9/1989 | Hays et al. | 399/266 |
| 4,994,859 | A * | 2/1991 | Mizuno et al. | 399/266 |
| 5,031,570 | A * | 7/1991 | Hays et al. | 399/266 |
| 5,287,152 | A * | 2/1994 | Oka et al. | 399/66 |
| 5,473,416 | A | 12/1995 | Endou et al. | |
| 5,594,534 | A * | 1/1997 | Genovese | 399/285 |
| 6,965,746 | B2 * | 11/2005 | Hays et al. | 399/270 |
| 2004/0258435 | A1 * | 12/2004 | Hays et al. | 399/266 |

FOREIGN PATENT DOCUMENTS

| | | | |
|---|---|---|---|
| JP | A-3-113474 | | 5/1991 |
| JP | 04046359 | A * | 2/1992 |
| JP | A-6-175485 | | 6/1994 |
| JP | A-9-54486 | | 2/1997 |

* cited by examiner

*Primary Examiner* — David Porta
*Assistant Examiner* — Kiho Kim
(74) *Attorney, Agent, or Firm* — Oliff & Berridge, PLC

(57) ABSTRACT

A developing device include: a toner carrier that is arranged oppositely to an image carrier; a toner-flying electrode member spaced apart from the toner carrier; and an oscillating electric field generating power source that connects the toner-flying electrode member and the toner carrier, and generates an oscillating electric field which causes the toner to fly from the toner carrier. The toner-flying electrode member includes a conductive member that extends at least along a rotational axis direction of the toner carrier; an insulating coating layer that applies insulating coating continuously to a conductive member surface located on a toner carrier side; and an exposed portion where the conductive member surface adjacent to the insulating coating layer and located on an image carrier side is exposed.

11 Claims, 15 Drawing Sheets

FIG. 13A
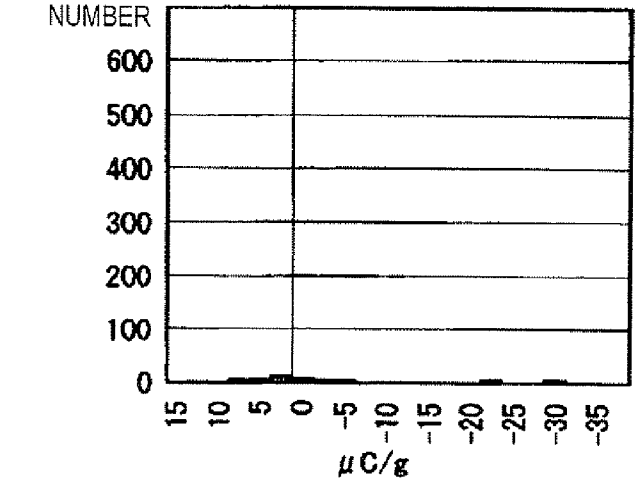
FIG. 13B
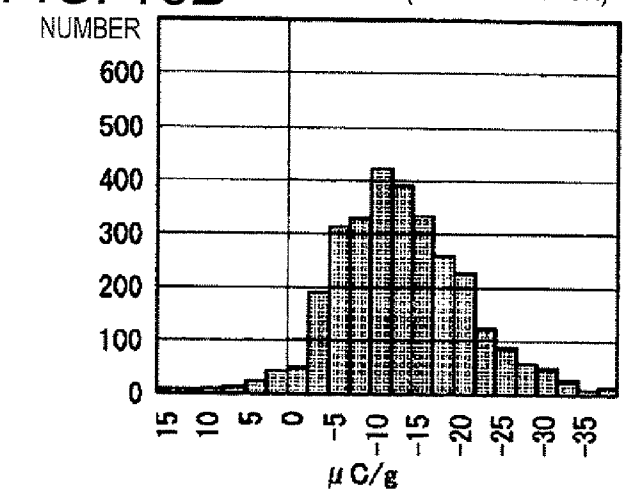
FIG. 13C
FIG. 13D

DEVELOPING DEVICE AND IMAGE FORMING APPARATUS

CROSS-REFERENCE TO RELATED APPLICATION

This application is based on and claims priority under 35 USC 119 from Japanese Patent Application No. 2010-066480 filed on Mar. 23, 2010.

BACKGROUND

Technical Field

The present invention relates to a developing device and an image forming apparatus using this device.

SUMMARY

According to an aspect of the invention, a developing device include: a toner carrier that is arranged oppositely to an image carrier on which an electrostatic latent image is held, and rotates with a toner charged and held on a peripheral surface thereof; a toner-flying electrode member spaced apart from the toner carrier; and an oscillating electric field generating power source that connects the toner-flying electrode member and the toner carrier, and generates an oscillating electric field which causes the toner to fly from the toner carrier, wherein the toner-flying electrode member includes: at least one conductive member that extends at least along a rotational axis direction of the toner carrier; an insulating coating layer that applies insulating coating continuously to a conductive member surface located on a toner carrier side so as to include, of the conductive member, at least the closest area to the toner carrier and the most protruding portion facing on a path in which the toner passes from the toner carrier toward the image carrier; and an exposed portion where the conductive member surface adjacent to the insulating coating layer and located on an image carrier side is exposed.

BRIEF DESCRIPTION OF THE DRAWINGS

Exemplary embodiments of the invention will be described in detail based on the following figures, wherein:

FIGS. 13A and 13B are graphs showing a result in an Example 2, and FIGS. 13C and 13D are graphs showing a result in a comparative example;

DETAILED DESCRIPTION

Outline of Exemplary Embodiment

Firstly, an outline of an exemplary embodiment of a developing device to which the invention is applied will be described.

Figure 1A:
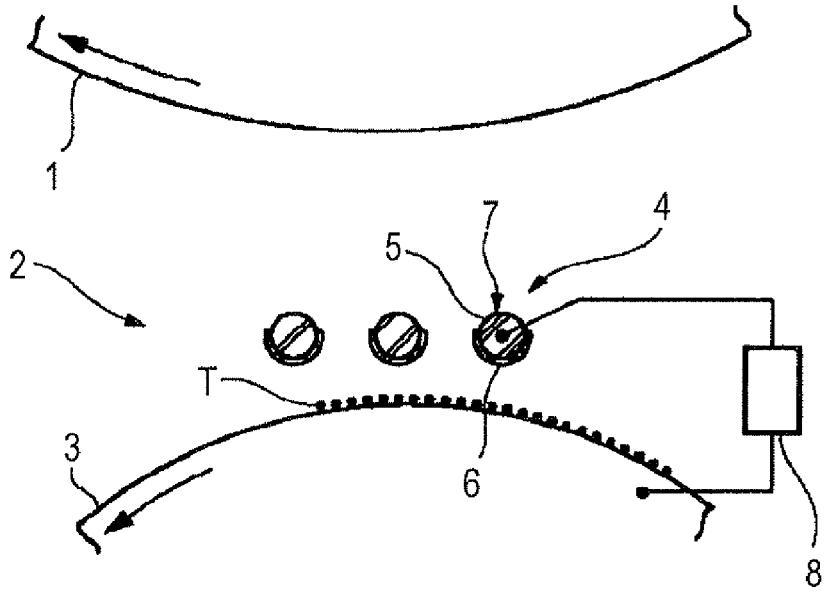
FIG. 1A and FIG. 1B are explanatory views showing an outline of an exemplary embodiment of an image forming apparatus which uses a developing device to which the invention is applied.

FIGS. 1A and B show an outline of an image forming apparatus according to an embodied model which embodies the invention. The image forming apparatus includes an image carrier 1 which rotates with an electrostatic latent image held, and a developing device 2 which is arranged oppositely to this image carrier 1 and causes toner T to fly toward the electrostatic latent image held on the image carrier 1 thereby to develop the electrostatic latent image.

Here, the developing device 2 includes a toner carrier 3 which is arranged oppositely to the image carrier 1 holding the electrostatic latent image and rotates with the charged toner T held on its peripheral surface, a toner-flying electrode member 4 spaced apart from this toner carrier 3, and an oscillating electric field generating power source 8 which connects this toner-flying electrode member 4 and the toner carrier 3 via cables and generates a predetermined oscillating electric field for causing the toner to fly from the toner carrier. The toner-flying electrode member 4 includes a conductive member 5 extending at least along a rotation axis direction of the toner carrier 3; an insulating coating layer 6 which applies continuously insulating coating to a surface located on the toner carrier 3 side of the conductive member 5 so as to include, of the conductive member 5, at least the closest portion to the toner carrier 3 and the most protruding portion facing on a path where the toner T passes from the toner carrier 3 toward the image carrier 1; and an exposed portion 7 which exposes a conductive member 5 surface which is adjacent to the insulating coating layer 6 and located on the image carrier 1 side.

Here, each of the image carrier 1 and the toner carrier 3 may be any of a drum-shaped member and a belt-shaped member as long as it may rotate with the toner T held.

Further, as long as the toner-flying electrode member 4 may cause the toner T on the toner carrier 3 to fly by an oscillating electric field at the opposite area between the image carrier 1 and the toner carrier 3, its shape is not particularly limited, but, for example, the wire shape, the mesh shape, the plate shape, or the like may be adopted.

Further, the oscillating electric field generating power source 8 generates an oscillating electric field applied between the toner carrier 3 and the toner-flying electrode member 4 (specifically, the conductive member 5). The oscillating electric field, as long as it has such a predetermined field intensity that the toner T may fly from the toner carrier 3, may have a direct electric field in a superimposition manner, including at least an alternating electric field.

As the conductive member 5 of the toner-flying electrode member 4, a metal-made member is preferable, but, for example, an insulating member may be plated with conductive material. Further, as the insulating coating layer 6, for example, insulating coating may be applied to the conductive member 5, or a part of the conductive member 5 may be subjected to insulating by oxidation treatment. At this time, in case that the thickness of the insulating coating layer 6 is too large, the field intensity of the oscillating electric field acting on the toner T on the toner carrier 3 becomes small, and unevenness is liable to be produced in the acting electric field by the thick insulating layer. Therefore, an insulating coating layer having a thickness of 10 μm or less is generally selected. It is enough that insulating properties of this insulating coating layer 6 are such that change in a charging state of the toner T itself is suppressed even when the toner T flying due to the oscillating electric field comes into contact with the insulating coating layer 6. Generally, the insulating properties having a volume resistivity of $10^{10}\Omega\cdot$cm or more are used.

As described above, the area where the insulating coating layer 6 is provided is set as the area "which applies continuously insulating coating to a surface located on the toner carrier 3 side of the conductive member 5 so as to include, of the conductive member 5, at least the closest portion to the toner carrier 3 and the most protruding portion facing on a path where the toner T passes from the toner carrier 3 toward the image carrier 1". This means that the area is high in possibility that the toner T put in a high-energy state by the oscillating electric field comes into direct contact with the conductive member 5 surface.

Figure 1B:
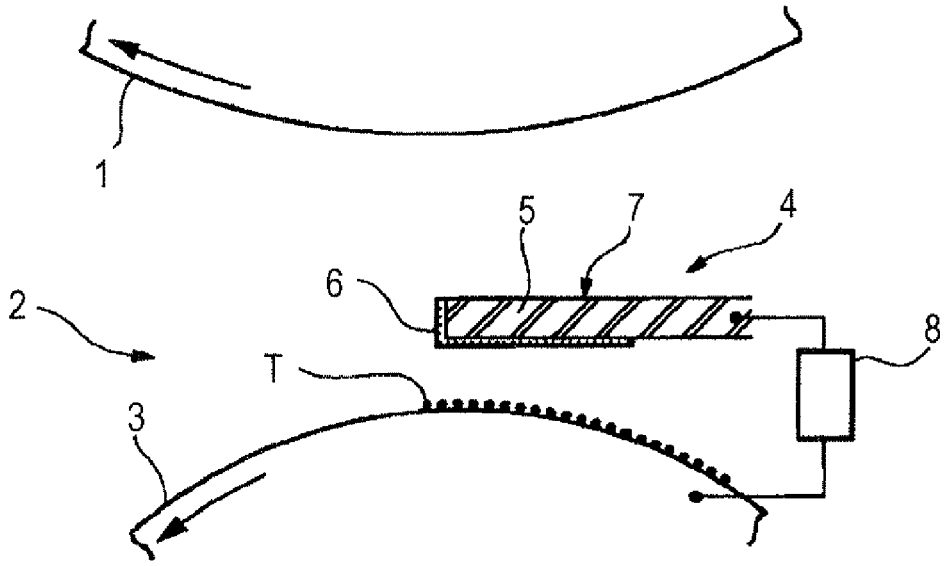
Figure 2A:
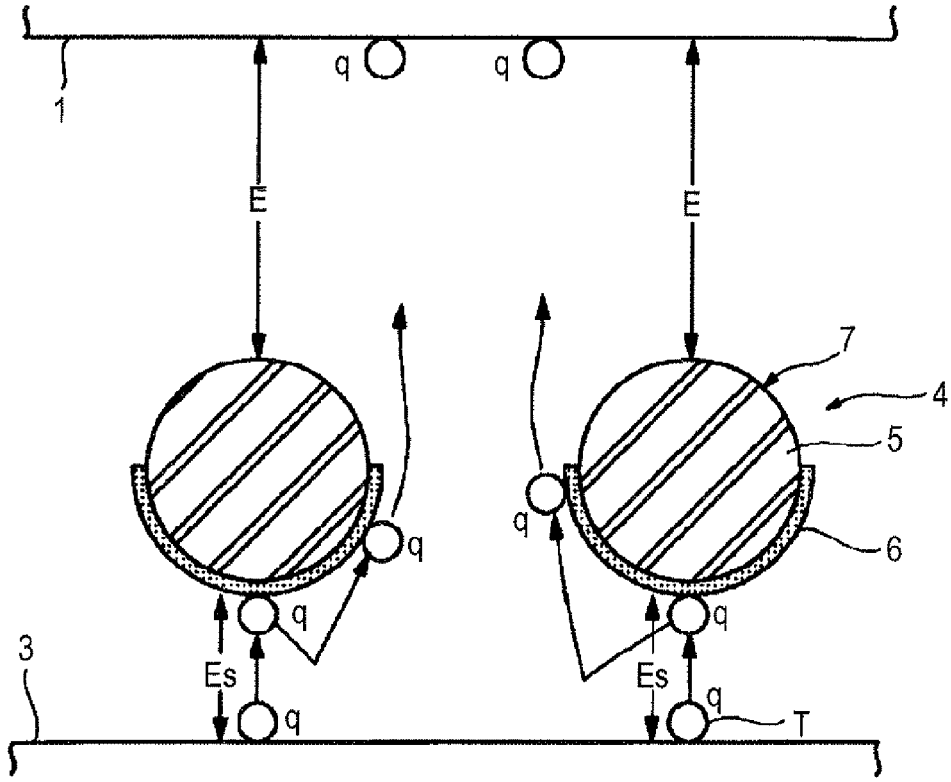
FIG. 2A is an explanatory view showing the working of a toner-flying electrode member and FIG. 2B is a graph showing a relation between toner resistance and electric field intensity.

FIG. 2A shows a schematic diagram showing an example in which the toner-flying electrode member 4 is arranged. An oscillating electric field (Es) produced by the oscillating electric field generating power source 8 (refer to FIG. 1) acts between the conductive member 5 of the toner-flying electrode member 4 and the toner carrier 3, whereby the toner T on the toner carrier 3 starts to fly. The toner T flying from the toner carrier 3 goes around the sides of the toner-flying electrode member 4 while repeating collision with the toner-flying electrode member 4 and goes toward the image carrier 1 side. At this time, of the toner-flying electrode member 4, the surface located on the toner carrier 3 side is covered with the insulating coating layer 6, and the protrusion end facing on the path where the toner T passes is also provided with the insulating coating layer 6. Therefore, when the charging amount of the toner T which has flown from the toner carrier 3 is taken as q, even in case that the toner T comes into contact with the toner-flying electrode member 4, the toner T comes into contact with the insulating coating layer 6, with the result that the charging amount q of the toner T is kept as it is. Further, even in case that the toner T comes into contact with the toner-flying electrode member 4 on the path where the toner T goes toward the image carrier 1, the toner T comes into contact with the insulating coating layer 6, with the result that the toner T goes toward the image carrier 1 side with the charging amount kept. Further, by providing the exposed portion 7 for the toner-flying electrode member 4, the effect by the exposed portion 7 continuously provided along the rotation axis direction of the toner carrier is exhibited. Therefore, an electric field E between the toner-flying electrode member 4 and the image carrier 1, even in case that it is smaller in intensity than the oscillating electric field Es, acts stably along the rotation axis direction, with the result that unevenness of the toner T adhering onto the image carrier 1 particularly along the rotation axis direction of the toner carrier 3 is improved greatly. If the insulating coating layer 6 is provided in place of the exposed portion 7, unevenness of electric field is liable to be produced along the rotation axis direction of the toner carrier 3, and unevenness in quantity of the toner T adhering onto the image carrier 1 is also produced along that direction, which is prone to a factor of occurrence of image unevenness.

As a first form of such the toner-flying electrode member 4, as shown in FIG. 1A, in a form where the conductive member 5 is composed of one or plural linear members, there is a toner-flying electrode member in which the insulating coating layer 6 applies insulating coating to, of the conductive member 5 surface, a surface located on the toner carrier 3 side at least throughout a semicircumference of the conductive member 5. As a typical form in which the conductive member 5 is thus constituted by the linear member, there is a member using a wire. The sectional shape of its member is not limited to the circular shape but may adopt any shape as long as the oscillating electric field acts effectively between the conductive member 5 and the toner carrier 3. For example, the conductive member 5 may be a stranded wire formed by twining wires. Further, the conductive member 5 may be a mesh-shaped member provided also in the direction along the rotational direction of the toner carrier 3. By thus using the linear member as the conductive member 5, the freedom degree in layout of the toner-flying electrode member 4 in the developing device 2 improves, and further the toner T comes to fly toward the image carrier 1 side at the area where the toner-flying electrode member 4 is arranged, of the opposite region between the toner carrier 3 and the image carrier 1. Further, in this form, the insulating coating layer 6 may be provided extending to an area over the semicircumference of the conductive member 5 as long as the exposed portion 7 is provided.

Further, as a second form of the toner-flying electrode member 4, as shown in FIG. 1B, in a form where the conductive member 5 is a plate-shaped member extending also along the rotational direction of the toner carrier 3, there is a toner-flying electrode member in which the insulating coating layer 6 applies insulating coating to, of the conductive member 5 surface, an end surface facing on the path where the toner T passes from the toner carrier 3 toward the image carrier 1 and a surface located on the toner carrier 3 side. In case that the conductive member 5 is thus the plate-shaped member, the field intensity by the oscillating electric field, on which particularly, an edge effect of the plate-shaped member acts greatly, is reduced greatly by the insulating coating layer 6. Further, in case that the plate-shaped conductive member 5 is used as the toner-flying electrode member 4, it is preferable, from a viewpoint that the oscillating electric field between the toner-flying electrode member 4 and the toner carrier 3 is stabilized more, that in a form in which the toner carrier 3 has a curved surface, the insulating coating layer 6 is provided except, of the conductive member 5 surface located on the toner carrier 3 side, a portion which is located on the upstream side in the rotational direction of the toner carrier 3 and corresponds to a region which is spaced apart from the toner carrier 3 and weak in oscillating electric field.

Considering a viewpoint that the toner T held by the toner carrier 3 keeps the more stable charging state, the developing device 2 may further include a charge injection mechanism which performs charge injection for the toner T to be held by the toner carrier 3. As such the charge injection mechanism, the known charge injection method may be adopted. The toner T is injection-charged by the charge injection mechanism, whereby an attention to environmental dependency is improved greatly, compared with a method in which the toner T is charged by triboelectric charging.

Figure 2B:
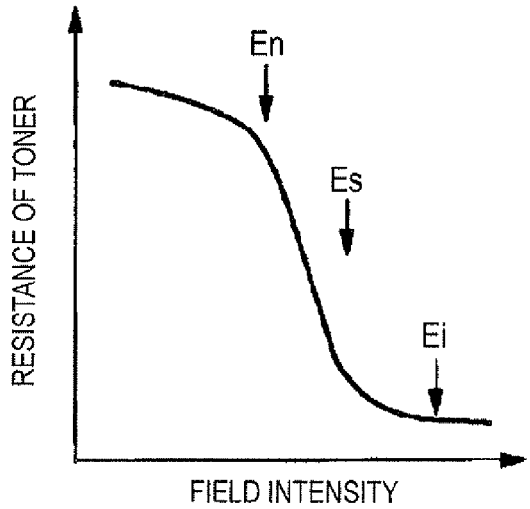

Next, the toner T in the exemplary embodiment model will be described. As shown in FIG. 2B, the toner T has resistance variation characteristics in which resistance varies sharply in excess of a normal electric field En determined in advance. The charge injection mechanism performs, in a predetermined injection electric field Ei which has field intensity larger than the intensity of the normal electric field En, the charge injection for the toner T put under a state where the resistance lowers. The oscillating electric field generating power source 8 may set the oscillating electric field Es between the normal electric field En and the injection electric field Ei. By thus using the injection electric field Ei having the field intensity larger than the intensity of the normal electric field En, the charge injection in the toner T is readily performed, and the toner T is caused to fly effectively from the toner carrier 3 by the oscillating electric field Es having the larger field intensity. Further, there is little fear that the charging state of the toner T changes by the oscillating electric field Es. Furthermore, even in case that the toner T of which the resistance is lowered comes into contact with the toner-flying electrode member 4 by the oscillating electric field Es, the possibility that the toner T comes into direct contact with the conductive member 5 is reduced greatly by the insulating coating layer 6, so that the change in the charging state of the toner T is suppressed.

Further, considering a viewpoint that unevenness of the electric field in the toner-flying electrode member 4 is reduced more, the insulating coating layer 6 may be provided in the toner-flying electrode member 4 in response to an area where the field intensity between the toner carrier 3 and the conductive member 5 exceeds the intensity of the normal electric field En. In this case, it is prevented in the field intensity exceeding the intensity of the normal electric field En that the toner T of which the resistance has lowered comes into direct contact with the conductive member 5, so that the charging state of the toner T is kept more stable.

Further, in this case, since an area where the field intensity is below the intensity of the normal electric field En, of the conductive member 5 surface is provided with the exposed portion 7, if compared with the case where this area is provided with the insulating coating layer 6, unevenness of the electric field between the toner-flying electrode member 4 and the image carrier 1 is reduced.

As necessity of the developing device 2 using a so-called toner cloud system in which the toner T is caused to fly from the toner carrier 3 by means of such the toner-flying electrode member 4, there are the following points.

Recently, diameter-reduction of the toner is advancing with the aim of enhancing image quality. However, with the diameter-reduction, the charging amount per toner also decreases, and an electrostatic force (qE) by a developing electric field used between an image carrier which holds an electrostatic latent image and a toner carrier which holds toner is becoming more and more equivalent in magnitude to a non-electrostatic force such as van der Waals force.

Therefore, it is assumed to make the developing electric field in the development time stronger than the developing electric field. In order to make the developing electric field strong, it is necessary to narrow a gap in the development time (gap between the image carrier and the toner carrier), and make large a difference between the latent image potential on the image carrier side and the potential on the toner carrier side. However, heretofore, as the developing electric field, the electric field having enough intensity on a level in which discharge is not produced has been used, and the present is under the situation where it is difficult to make the developing electric field further stronger.

Further, in order to increase the electrostatic force by the developing electric field, it is also assumed to make the charge amount (charging amount) per toner large. However, since charging of toner utilizes the surface of the toner, considering that the surface area of the toner decreases at a rate of the square by the diameter reduction, this assumption is difficult. Further, in case that the charge amount is simply increased, since the electrostatic adhesive force is proportional to the square of q/d in which d is the diameter of toner, the large field intensity becomes by contrast necessary to cause the toner to fly from the toner carrier in this case.

From such the reason, there has been proposed the developing system (toner-cloud development) in which an electrode member (corresponding to the toner-flying electrode member) for causing toner to fly from a toner carrier is provided between an image carrier and the toner carrier, and stronger field intensity is applied between the electrode member and the toner carrier thereby to cause the toner to fly.

On the other hand, as charging of toner, triboelectric charging has been used. However, this triboelectric charging is liable to receive influences of temperature, humidity, a surface state of a member used in charging, and the like. Particularly, the influence of humidity is large, and the charging amount of toner is different greatly between the high-humidity time and the low-humidity time, which becomes a factor of narrowing an appropriate width of the charging amount in the developing time.

As a toner charging system replacing such the triboelectric charging system, a charge injection (injection-charging) system has been proposed. However, in case that application of such the charge injection system to the toner is attempted, its application is difficult, and the toner requires characteristics in which the resistance lowers in the charge injection time.

The invention, in view of such the points, has been devised.

It is better that an image forming apparatus using the developing device 2 in the exemplary embodiment model includes an image carrier 1 which rotates with an electrostatic latent image held, and a developing device 2 arranged oppositely to this image carrier 1; and uses the above-mentioned developing device 2 as this developing device 2.

As a first form of such the image forming apparatus, for example, as shown in FIG. 1A, in a form where a conductive member 5 is composed of plural linear members, there is a toner-flying electrode member 4 in which plural linear members as the conductive member 5 are arranged in the closest area between the image carrier 1 and a toner carrier 3 and in a region along the rotational direction of the toner carrier 3. In this form, it is enough that the toner-flying electrode member 4 includes an exposed portion 7 at least at a part of the conductive member 5 surface located on the image carrier 1 side.

Further, as a second form of the image forming apparatus, for example, as shown in FIG. 1B, in a form where the conductive member 5 is a plate-shaped member, there is a toner-flying electrode member 4 in which a plate-shaped member is arranged nearer the upstream side in the rotational direction of the toner carrier 3 in relation to the closest area between the image carrier 1 and the toner carrier 3. Here, arranging the plate-shaped member nearer the upstream side means including a case where an end of the plate-shaped member on the downstream side in the rotational direction of the toner carrier 3 is located on a more upstream side than the closest area, a case where the end position thereof coincides with the closest area, and a case where the end thereof is located on a more downstream side than the closest area. For example, in case that the end thereof is located on the more downstream side than the closest area, it is natural that the end is arranged in such a position that the toner T is caused to fly effectively from the toner carrier 3 and the flying toner T goes toward the image carrier 1 side.

Further, in such the image forming apparatus, from a viewpoint that the developing density at the developing time is increased, the rotational speed of the toner carrier 3 may be set higher than the rotational speed of the image carrier 1.

Further, as a preferred image forming apparatus to which such the developing device 2 is applied, there is the following. Namely, its image forming apparatus includes an image carrier 1 which has a rotatable support having a circumferential surface larger than a maximum image forming area, and pixel electrodes arranged on this support in matrix for each pixel unit along the rotational direction of the support and the cross direction crossing to this rotational direction; and a latent image writing means which applies a latent image voltage based on an image signal to each pixel electrode in a line selected by a scanning signal, of pixel electrode groups in respective lines along the cross direction, thereby to write a latent image. In case that such a so-called active matrix type image carrier 1 is used, even in case that the latent image voltage (corresponding to latent image potential) to be applied to the pixel electrode is small, the effective development is performed.

Next, the invention will be further described in detail on the basis of exemplary embodiments shown in drawings.

First Exemplary Embodiment

Figure 3:
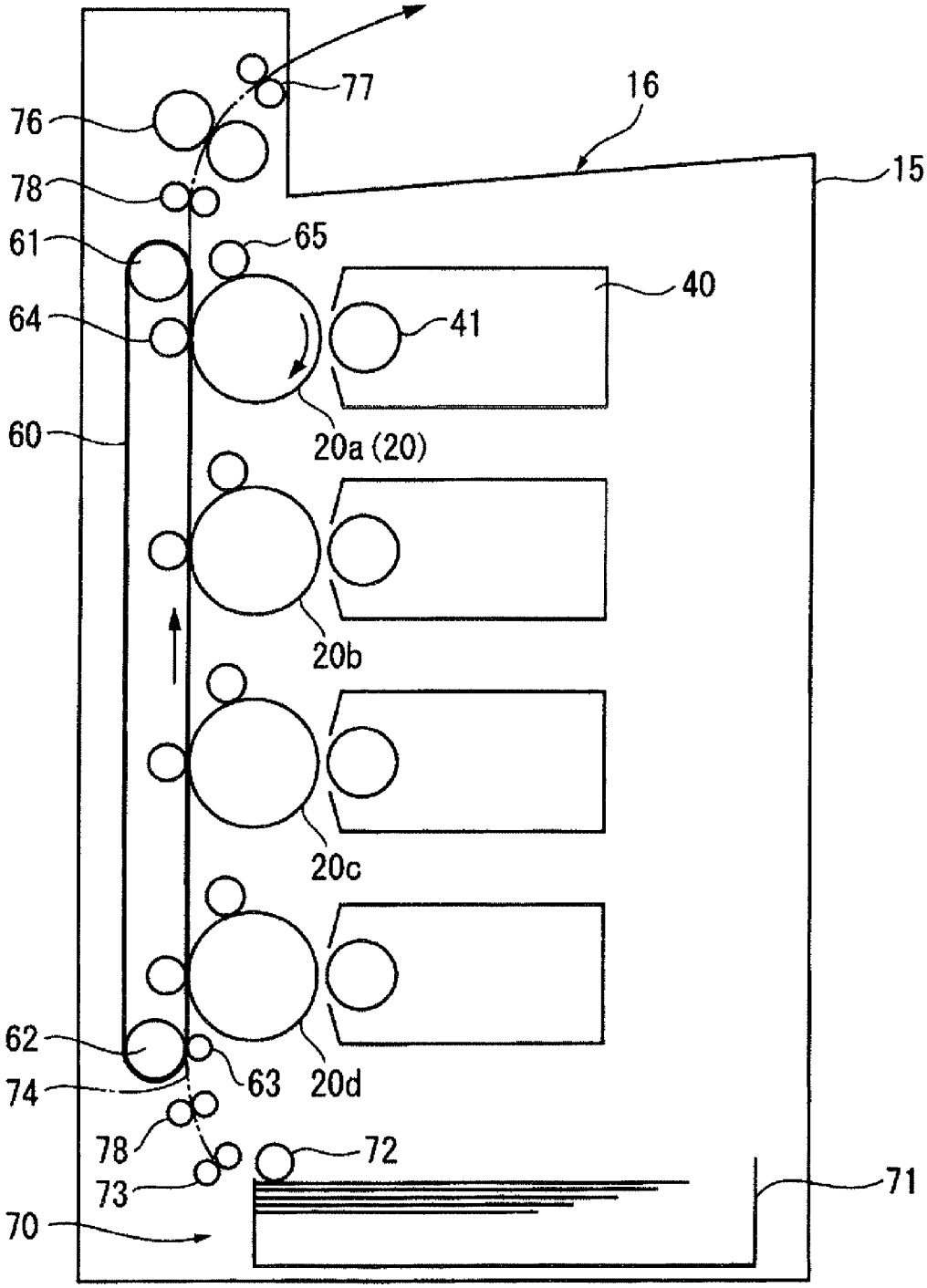
FIG. 3 is an explanatory view showing an outline of the entire constitution of an image forming apparatus according to a first exemplary embodiment.

FIG. 3 shows a first exemplary embodiment of an image forming apparatus in the exemplary embodiment model to which the invention is applied.

<Entire Constitution of Image Forming Apparatus>

In FIG. 3, the image forming apparatus in this exemplary embodiment is a so-called tandem type color image forming apparatus, in which image holding bodies 20 (20*a* to 20*d*) for four colors on which each color toner image of each color component (for example, yellow (Y), magenta (M), cyan (C), and black (K)) is formed by, for example, electrophotography are arranged inside an apparatus housing 15 in the substantially vertical direction.

In a position opposite to the image holding bodies 20*a* to 20*d* for four colors, there is provided a recording material transport belt 60 which is laid around two tension rolls 61 and 62, transports a recording material while adsorbing it, and rotates circularly, for example, with the tension roll 61 as a drive roll. Further, in a position opposite to the tension roll 62 with the recording material transport belt 60 between, there is provided a charger 63 for adsorbing the recording material onto the recording material transport belt 60. Around the image carrier 20 for each color, there are provided a developing device 40 which develops an electrostatic latent image formed on the image carrier 20 by toner and makes the latent image visible, and a cleaning device 65 which cleans residual toner on the image carrier 20. Further, in a position opposite to the image carrier 20 for each color with the recording material transport belt 60 between, there is provided a transfer device 64 which transfers a toner image on the image carrier 20 onto a recording material transported by the recording material transport belt 60. A reference numeral 41 represents a development roll which supplies in the developing device 40 (described later in detail) the toner to the image carrier 20.

Further, in the lower position inside the apparatus housing 15, a recording material supply device 70 which supplies a recording material is provided, and the recording materials accommodated in a supply container 71 are supplied by a feed roll 72 and a fanning mechanism 73 one by one toward a recording material transport path 74 extending in the vertical direction.

Therefore, the recording material supplied from the recording material supply device 70 to the recording material transport path 74, after being aligned once by a registration roll 78 arranged on the downstream side of the recording material transport path 74, is transported further on the recording material transport path 74 at the predetermined timing. Then, the transported recording material is adsorbed onto the recording material transport belt by the charger 63, and transported with rotation of the recording material transport belt 60 as it is. Onto the recording material on the recording material transport belt 60, toner images of the respective colors are transferred in turn by the transfer devices for the respective colors and multi-layered. The toner images multi-layered on the recording material are fixed by a fixing device 76, and thereafter the recording material is exhausted from an exit roll 77 to a recording material exhaust receiver 16 constituted by a part of the apparatus housing 15. Further, on the recording material transport path 74, transport member (for example, transport rolls) 78 for transporting the recording material are appropriately provided. Furthermore, in the vicinity of an exit of the recording material transport belt 60 (in the vicinity of the tension roll 61), a not-shown separation member is provided, by which separation of the recording material from the recording material transport belt 60 is readily performed.

<Image Carrier>

Next, the image carrier 20 used in the exemplary embodiment will be described in detail.

Figure 4:
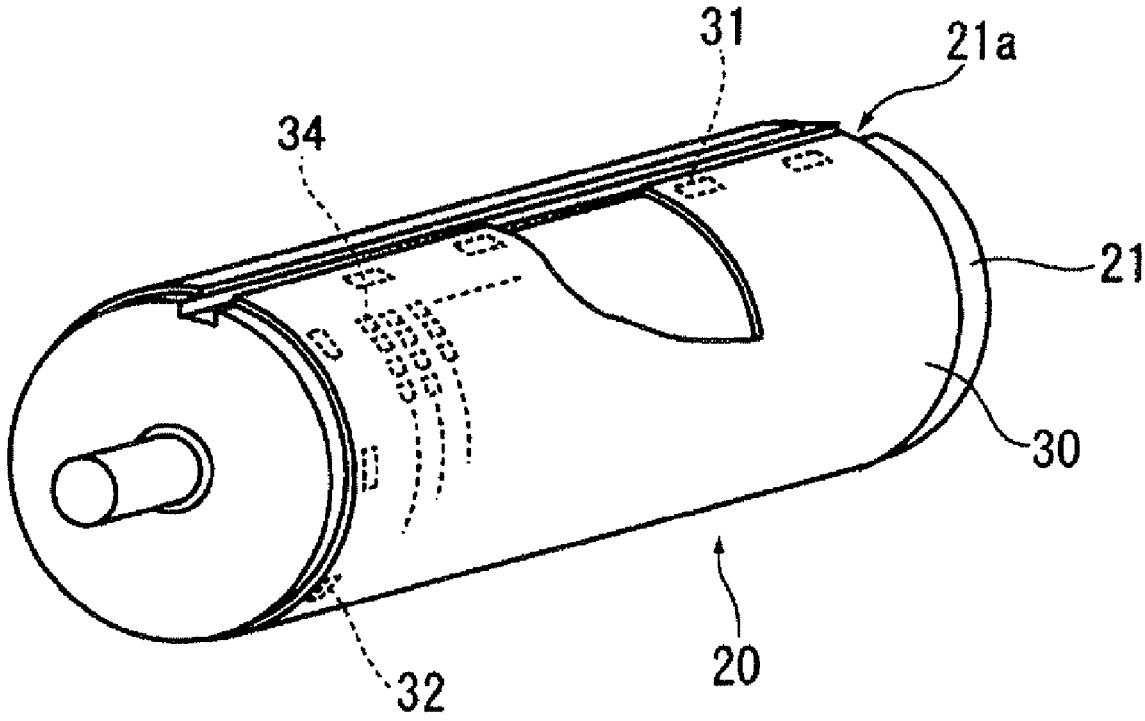
FIG. 4 is an explanatory view showing the constitution of an image carrier in the first exemplary embodiment.

The image carrier 20 in the exemplary embodiment is so constituted, as shown in FIG. 4, that a pixel electrode film 30 in which many pixel electrodes 34 are formed on a film in matrix arrangement (so-called in matrix) is wound around and fix-supported by a rigid drum 21 which is a rotatable support.

In this exemplary embodiment, the pixel electrode film 30 is manufactured by using a thin-film technology used in an IC manufacturing process or the like on a polyimide resin film substrate, in which the pixel electrodes 34 are arranged in matrix. In the pixel electrodes 34 thus arranged in matrix, a data line is provided, for example, in a direction along the rotational direction of the rigid drum 21, and a scanning line is provided in a direction along the rotational axis direction of the rigid drum 21. The data lines and the scanning lines corresponding to the respective pixel electrodes 34 are collected respectively and connected to the appropriate number of data drivers 31 and scanning drivers 32. The pixel electrode film 30 is covered with a not-shown protective film in whole so as to cover the pixel electrodes 34. Further, a reference numeral 21*a* in the figure is a groove opened in a part of the peripheral surface of the rigid drum 21 along the rotational axis direction. Under the structure in this exemplary embodiment, the end portion of the pixel electrode film 30 gets into the inside of the rigid drum 21 from this groove 21*a*.

Surrounding Structure of Pixel Electrode

Next, the pixel electrode 34 of the pixel electrode film 30 and the surrounding structure of the pixel electrode 34 will be described.

Figure 5A:
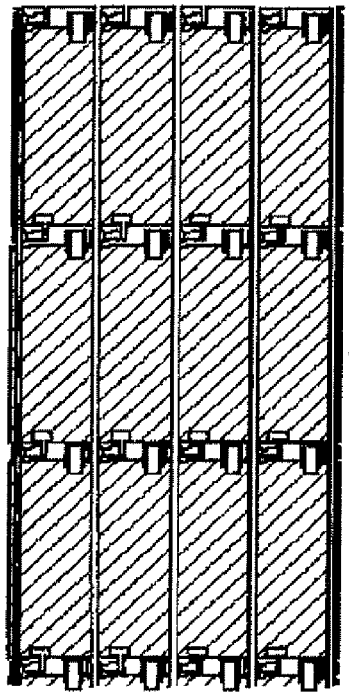
FIGS. 5A and 5B are explanatory views showing the constitution of a pixel electrode.
Figure 5B:
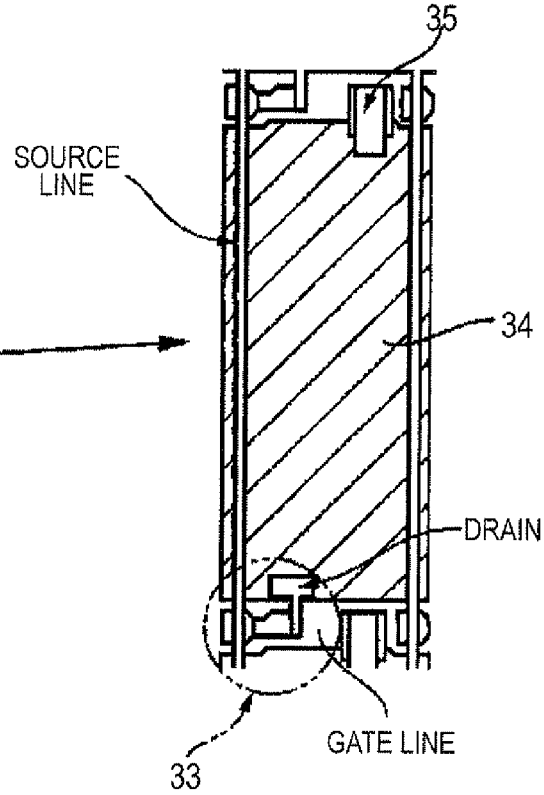
Figure 5C:
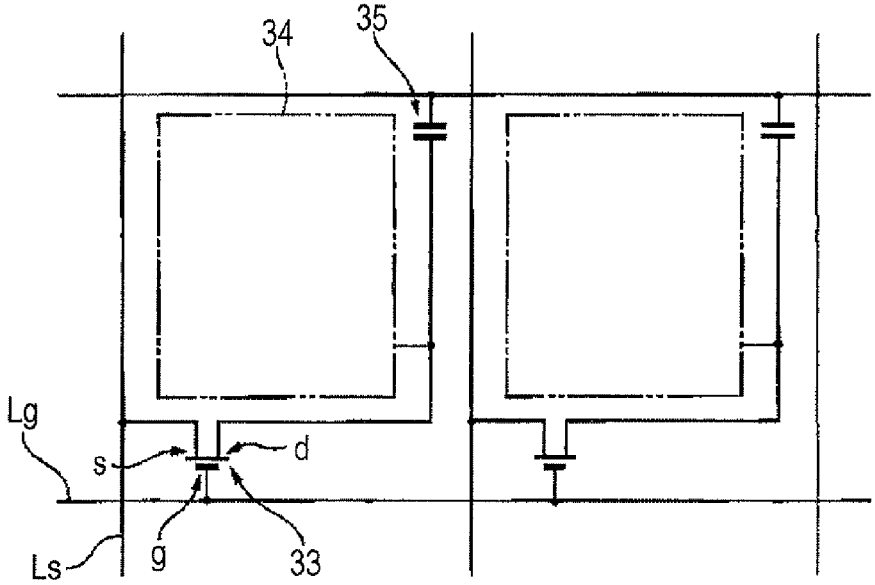
FIG. 5C is an explanatory view showing an equivalent circuit.

In the exemplary embodiment, the pixel electrode film 30, as shown in FIGS. 5A to 5C, is constituted by the active matrix type pixel electrodes 34. As a switching element for switching the pixel electrode 34, for example, a TFT (Thin Film Transistor) 33 is used, to which a storage capacitor 35 and wiring (source line Ls, gate line Lg and the like) are added respectively.

Wire connections between the pixel electrodes 34 are collected respectively as a source line Ls to which sources s of the TET's 33 are wire-connected for each data line, and as a gate line Lg to which gates g of the TET's 33 are wire-connected for each scanning line. Further, to a drain d of the TFT 33, the corresponding pixel electrode 34 and storage capacitor 35 are connected in parallel, and one-sides of the storage capacitors 35 are collected through each gate line Lg. Therefore, the surrounding structure of the pixel electrode 34 is constituted so as to produce an equivalent circuit as shown in FIG. 5C.

Since the many pixel electrodes 34 are arranged in matrix in the pixel electrode film 30, the pixel electrodes 34 are driven as follows.

Figure 6:
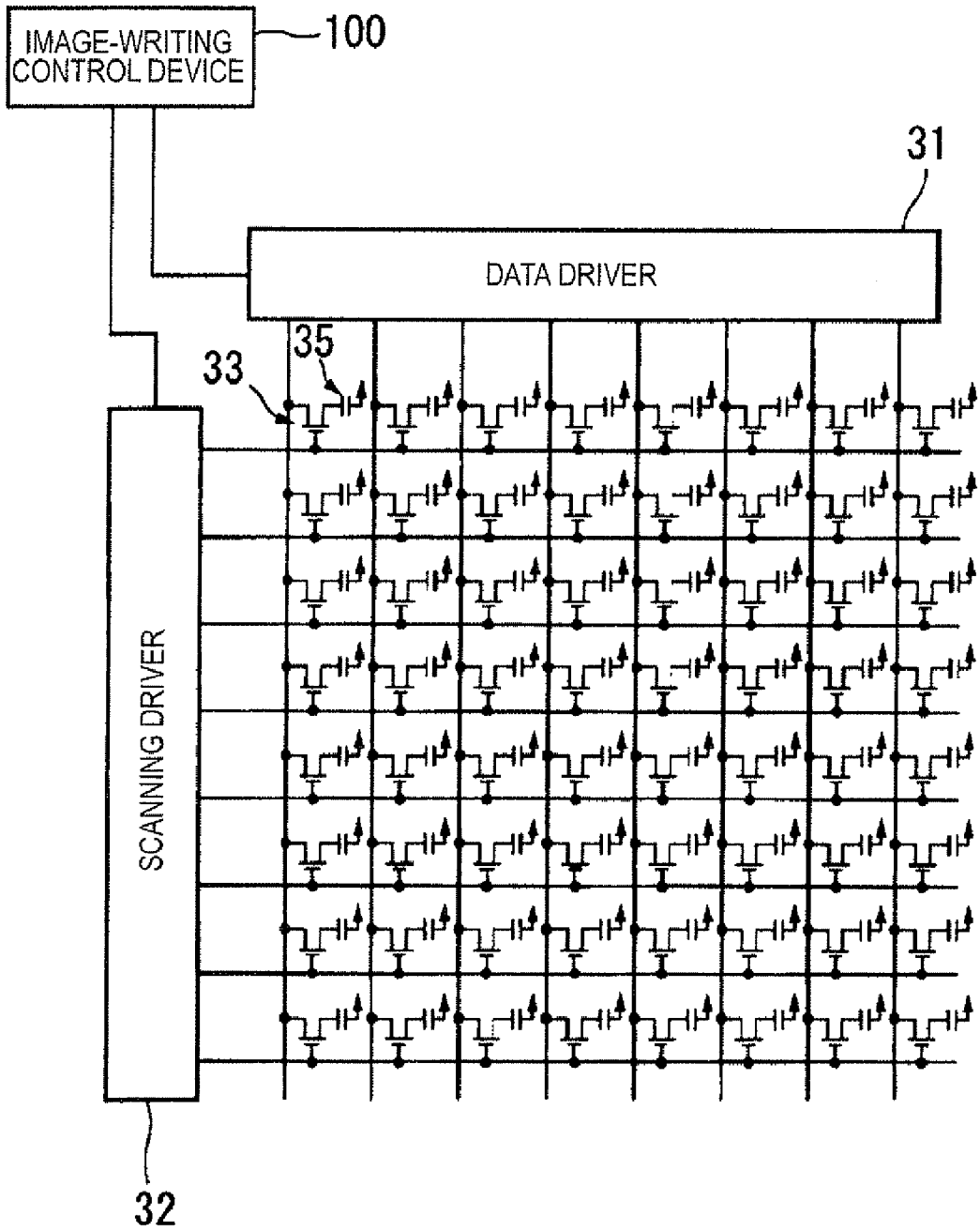
FIG. 6 is an explanatory view showing a driving system of the pixel electrode.

Namely, in the pixel electrode film 30, as shown in FIG. 6, the predetermined numbers of pixel electrodes 34 are arranged in each data line and each scanning line. The source s side of the TFT 33 which switches each pixel electrode 34 is connected through each data line to the data driver 31, while the gate g side of the TFT 33 is connected through each scanning line to the scanning driver 32. Further, these data driver 31 and scanning driver 32 are driven by an image-writing control device 100 provided for the image carrier 20, whereby a latent image voltage based on an image signal is applied to the selected pixel electrode 34, and held by the storage capacitor 35. Though the pixel electrode 34 is omitted in FIG. 6, it goes without saying that the pixel electrode 34 is connected, as shown in FIG. 5 C, between the TFT 33 and the storage capacitor 35.

<Developing Device>

Constitutional Example of Developing Device

In the exemplary embodiment, for a developing device 40, the constitution using injection-charging type toner is adopted.

Figure 7:
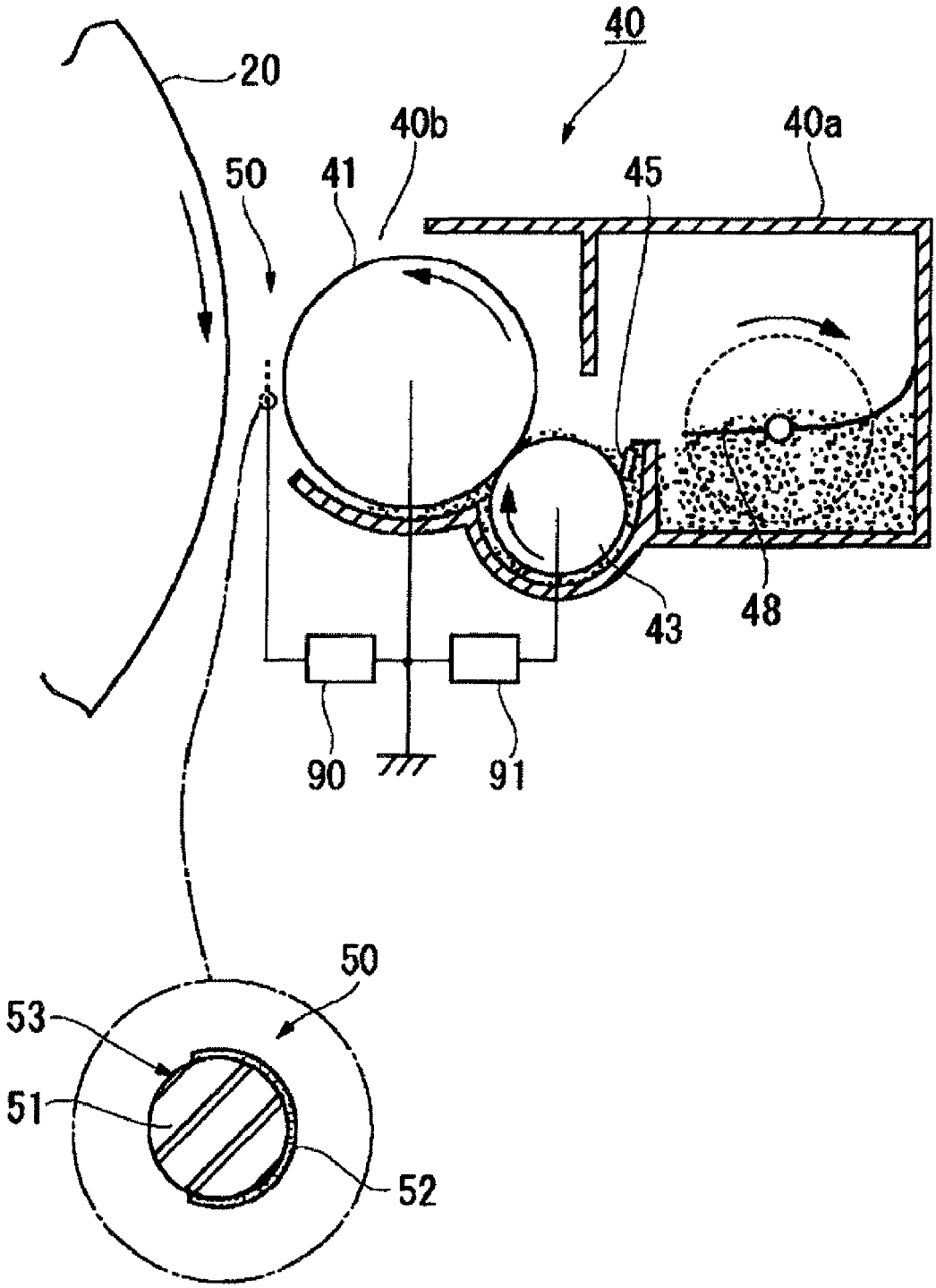
FIG. 7 is an explanatory view showing a developing device in the first exemplary embodiment.

The developing device 40 in the exemplary embodiment includes, as shown in FIG. 7, a development container 40*a* in which toner is accommodated and a development opening 40*b* is provided oppositely to the image carrier 20; and a development roll 41 which is spaced apart from the image carrier 20, facing this development opening 40*b*, and rotates at an opposite area to the image carrier 20 in the same direction as the rotational direction of the image carrier 20. The developing device 40 develops an electrostatic latent image formed on the image carrier 20 at the opposite area between the image carrier 20 and the development roll 41 thereby to make the electrostatic latent image visible.

In the exemplary embodiment, a gap between the image carrier 20 and the development roll 41 is, for example, 50 μm, and the peripheral speeds of the image carrier 20 and the development roll 41 are 20 mm/s and 60 mm/s respectively, in which the peripheral speed of the development roll 41 is higher.

Further, on the side different from the image carrier 20 side of the development roll 41, there is provided a charge injection roll 43 which performs charge injection for the toner between the roll 43 and the development roll 41. These rolls 41 and 43 rotate, in a state where they come into slight contact with each other or are supported with a small clearance between them, in the same direction at the opposite area. In this exemplary embodiment, the peripheral speed of the charge injection roll 43 is set so as to become about two times higher than the peripheral speed of the development roll 41. Between the development roll 41 and the charge injection roll 43, there is provided an injection electric field generating power source 91 which generates an injection electric field for performing the charge injection for the toner located at the opposite area. Namely, in the exemplary embodiment, the charge injection roll 43 and the injection electric field generating power source 91 constitute a charge injection mechanism.

Further, on a more upstream side along the rotational direction of the charge injection roll 43 than the opposite area between the development roll 41 and the charge injection roll 43, there is provided a layer regulating blade 45 which forms a thin toner layer on the charge injection roll 43. By this layer regulating blade 45, the thickness of the toner layer on the charge injection roll 43 is regulated, whereby the toner having the regulated layer thickness is transported to the area opposite to the development roll 41 and subjected to the charge injection.

Further, on the back side of the charge injection roll 43 inside the development container 40*a*, an agitator 48 which agitates the toner is provided and performs the toner supply to the charge injection roll 43 side.

The development roll 41 used in the exemplary embodiment is formed by providing a silicon rubber layer which has a rubber thickness of about 5 mm and is relatively low in resistance around a core bar of made of, for example, free-cutting stainless steel (SUM), and covering the surface of the silicon rubber layer with a fluorine resin coat layer which is relatively high in resistance in thickness of about 20 μm. Regarding such the development roll 41, Asker C hardness is about 50 degrees, and the resistance is about $10^8\Omega$ viewing from the electric current when a voltage of 100V is applied in a state where the development roll 41 is pressed on a metal plate at a linear pressure of 200 gf/cm. The resistance of the underlying silicone rubber layer is set one or more digit lower than this resistance.

Further, the layer regulating blade 45 is formed by fixing, for example, silicone or EPDM rubber to a stainless-made plate spring having a thickness of about 0.03 to 0.3 mm with an adhesive. A free end of this layer regulating blade 45 comes into slight contact with the surface of the charge injection roll 43, and a fixing end thereof is fixed to a part of the development container 40*a*.

In the developing device 40 in the exemplary embodiment, a toner-flying electrode member 50 is provided at the opposite area between the development roll 41 and the image carrier 20. This toner-flying electrode member 50 is provided in a gap between the image carrier 20 and the development roll 41 nearer to the development roll 41, and arranged in this exemplary embodiment so that the gap between the member 50 and the development roll 41 is about 30 μm. Further, the toner-flying electrode member 50 includes plural conductive members 51 each formed of a linear member, which are stretched at predetermined intervals at least along the rotational axis direction of the development roll 41. The toner-flying electrode member 50 is supported in a state where ends of each linear member are stretched between both end sides in the rotational axis direction of the development roll 41.

In the toner-flying electrode member 50, an insulating coating layer 52 is formed so as to cover the conductive member 51 surface located on the development roll 41 side at least in a range of a semicircumference, and the conductive member 51 surface located on the image carrier 20 side where the insulating coating layer 51 is not provided is exposed to form an exposed portion 53. Namely, herein, the conductive member 51 surface on the development roll 41 side is subjected to insulating coat in the range over the semicircumference thereof.

As the conductive member 51 in this exemplary embodiment, a stainless wire having a wire diameter of about 30 μm is used, and the wires are stretched with wide interval enough for the toner which has flown from the development roll 41 to pass. Further, the insulating coating layer 52 is formed by applying, for example, a resin solution in which resin is solving in a solvent to a part of the conductive member 51 and evaporating the solvent in a heating furnace to obtain a coat having a thickness of about 3 μm.

The conductive member 51 and the insulating coating layer 52 are not limited to these materials. As the conductive member 51, wires other than the stainless wire such as a piano wire and a tungsten wire may be used, and the used wire may have another wire diameter. Further, for example, gold plating may be applied to these wire material surfaces. On the other, as the resin used in the insulating coating layer 52, for example, phenol, PTFE, PFA, ETFA, or the like may be used. Furthermore, the insulating coating layer 52 is not limited to the resin, but, for example, a titania or alumina ceramic coat may be used. As resistance of the insulating coating layer 52, a resistance of $10^{12}\Omega\cdot$cm or more is preferable in order to prevent the charge injection from the conductive member 51 into the toner when the toner comes into contact with the insulating coating layer 52. Further, as a method of proving such the insulating coating layer 52 for a part of the conductive member 51, the known technology may be used, such as spray coating from one direction, masking or the like.

Further, in the exemplary embodiment, in addition to the injection electric field generating power source 91 provided between the charge injection roll 43 and the development roll 41, there is provided an oscillating electric field generating power source 90 which generates an oscillating electric field between the development roll 41 and the conductive member 51. In this exemplary embodiment, the injection electric field generating power source 91 is so set that the charge injection roll 43 side is lower in 100V of potential than the development roll 41 side. On the other hand, in the oscillating electric field generating power source 90, a development roll 41 side is grounded, and a square wave of for example, 600 Vpp and 15 kHz acts on the conductive member 51.

Example of Toner Structure

Regarding the structure of the toner used in the exemplary embodiment, for example, ITO particulates are made to adhere to the surface of insulating toner thereby to obtain a conductive base, and thereafter, insulating fines are made to adhere to the surface of the conductive base. More specifically, as insulating toner, for example, spherical toner having an average particle diameter of 6.5 μm is used, and ITO particulates of 15 wt % are added to the insulating toner and mixed therein by a sample mill (SK-M10 type by Kyoritsu Riko Co., ltd.) at 12000 rpm for 30 seconds. Thereafter, the refined latex fines (the same resin as the insulating toner) is added to the ITO-added insulating toner and mixed therein by the water-cooled sample mill at 12000 rpm for 30 minutes, whereby toner is manufactured. Further, the toner is not limited to this toner but any toner may be used as long as it is injection charging type toner, and a method of manufacturing its toner may use the known technology.

When an injection electric field having a high intensity acts on such the toners, between the toners, the conductive bases come into contact with each other through each insulating layer of the refined latex fines. By the action of the high electric field on this insulating layer, the conductive base electrically conducts due to the tunnel effect thereby to perform the charge injection for the toner.

The toner is not limited to the toner having this structure, but may have such structure that a conductive toner base (conductive core) 81 made of conductive material is provided, the surroundings of this conductive core 81 are coated with an insulating coating layer (for example, insulating resin layer) 82, and the appropriate number of recess portions 83 are provided in the insulating coating layer 82 so that a part of the conductive core 81 is exposed. Such the toner may be manufactured by a polymerization method or the known encapsulation technologies. At this time, the conductive core 81 is manufactured by dispersing conductive agent such as transparent conductive powders of conductive carbon or ITO in polyester resin or styrene acryl resin, or coating a particle surface made of polyester resin or styrene acryl resin with the conductive agent.

When a high electric field is applied to such the toner, the toner tends to exhibit the decrease of resistance. The field intensity which causes the decreases of resistance depends mainly on an occupation rate of the recess portion 83 of the toner or the thickness of the insulating coating layer 82.

This mechanism is inferred as follows. Namely, since the conductive core 81 is coated with the insulating coating layer 82, the conductive cores 81 hardly come into contact with one another and hardly come into direct contact with the electrode member, and each keeps a fixed minute clearance through the insulating coating layer 82. Accordingly, when the high electric field acts on the toner, the conductive core 82 electrically conducts due to the tunnel effect.

Figure 8A:
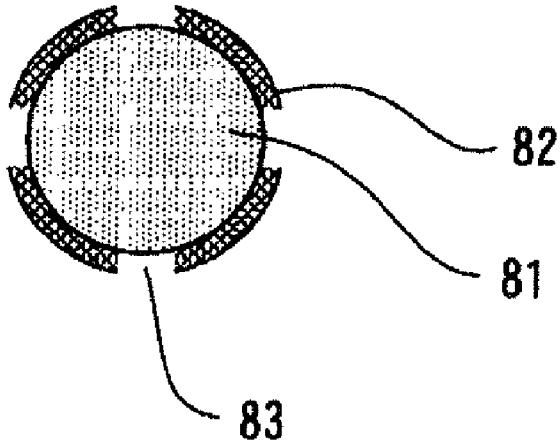
FIGS. 8A and 8B are explanatory views showing conductive toner.
Figure 8B:
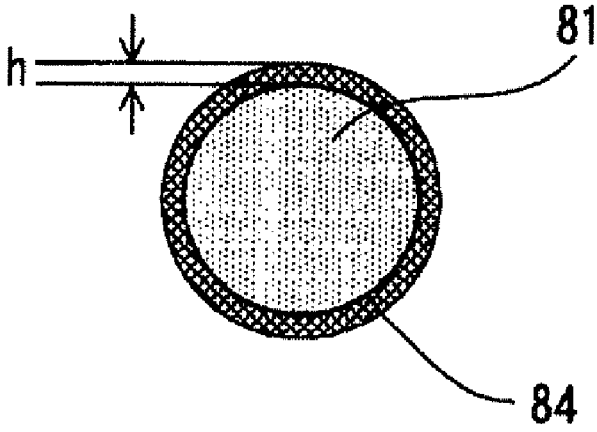

Further, as another form of such the toner, as shown in FIG. 8B, there is, for example, toner in which a conductive core 81 is coated with an insulating or semiconductive coating layer 84, and a thickness h of the semiconductive coating layer 84 is adjusted appropriately thereby to enable adjustment of toner resistance. At this time, for the semiconductive coating layer 84, a material which has semiconductivity in itself may be used; or a semiconductive resin formed by containing a metal oxide such as titanium oxide or tin oxide, or conductive carbon in an insulating resin in minute amounts may be used. As the conductive core 81, a form in which conductive fines are made to adhere to the vicinity of an outer surface of an insulating toner base (insulating core) composed of the normal insulating toner, a form in which conductive fines are mixed into an insulating core, and the like may be appropriately selected.

<Operation of Image Forming Apparatus>

Next, an outline of the operation of the image forming apparatus according to the exemplary embodiment will be described.

Latent Image Formation on Image Carrier

A latent image voltage according to an image signal is applied to each pixel electrode 34 (refer to FIG. 4) of the image carrier 20*a* to 20*d* (refer to FIG. 3) for each color, whereby a latent image is held by the image carrier 20. In the exemplary embodiment, each latent image voltage is set so that a surface potential in an image portion of the image carrier 20 becomes, for example, +50V, and a surface potential in a non-image portion thereof becomes, for example, −50V.

Operation of Development Device

Next, referring first to FIG. 7, the operation of the developing device 40 will be described, centering on a charge injection step for the toner.

The toner agitated by the agitator 48, after being supplied to the charge injection roll 43 side, is transported with rotation of the charge injection roll 43, the layer thickness of the toner is regulated by the layer regulating blade 45, and the substantially uniform toner layer is formed on the charge injection roll 43. This uniformly formed toner layer, while being rubbed at the opposite area where the charge injection roll 43 and the development roll 41 are opposed to each other in a nipped state between the both rolls which rotate in the same direction, is subjected to charge injection by the injection electric field generated by the injection electric field generating power source 91. At this time, since the peripheral speed of the charge injection roll 43 is set higher than the peripheral speed of the development roll 41, rubbing of the toner is effectively performed, and good charge injection is performed.

In such the state, the toner nipped between the both rolls comes into contact with the charge injection roll 43 with higher possibility, and further the contact resistance against the toner may be reduced. In result, apparent resistance of the toner is reduced, and the toner is subjected effectively to the charge injection, remaining in the low-resistance state. Therefore, even in case that the injection electric field is relatively low, the charge injection is efficiently performed for the toner.

Thus, by performing the charge injection for the toner of the single layer or less, the charge injection for the toner is effectively performed, and occurrence of WST (Wrong Sign Toner: toner charged with the polarity opposite to the proper charging polarity of the toner) is suppressed. Thereafter, on the development roll 41 portion passing through the opposite area to the charge injection roll 43, a uniform toner layer having a single layer or less in which the charge injection has been performed is formed, and then the toner layer is transported to the opposite region between the development roll 41 and the image carrier 20. In such the charge injection type, since shear force is applied between the toner layers, the toners are prevented from being superimposed on each other in a polarized state, and the occurrence of the WST is prevented even if the injection electric field is high.

Toner Motion in Development

Next, toner motion in the opposite area between the image carrier 20 and the development roll 41, which is a feature of the exemplary embodiment, will be described.

Figure 9A:
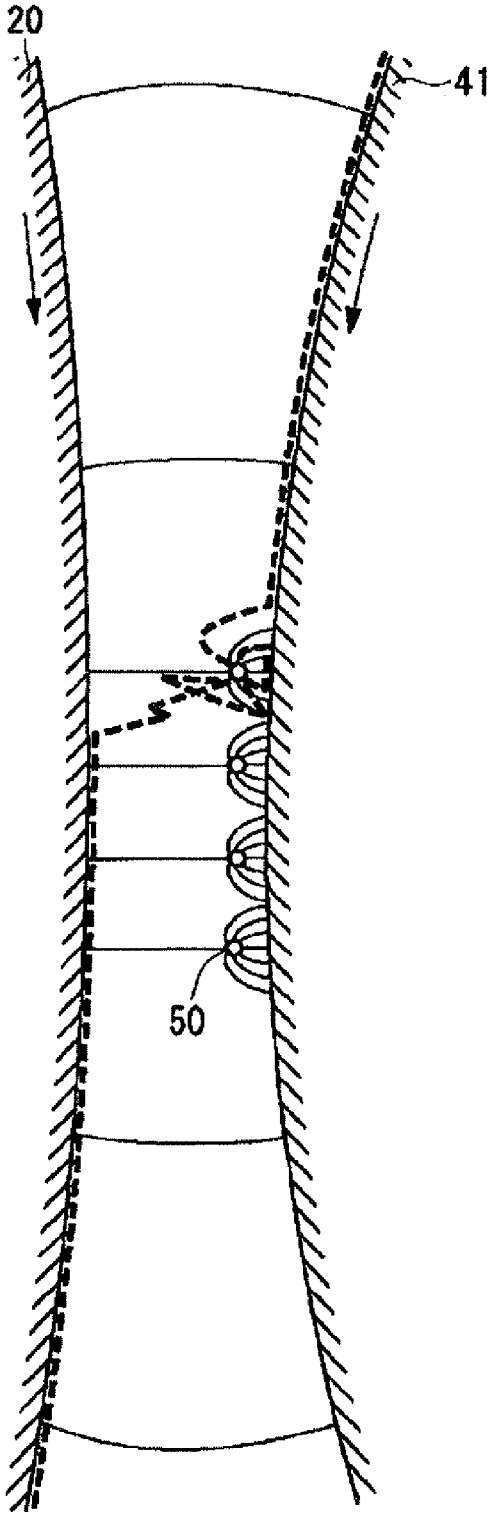
FIGS. 9A and 9B are explanatory views showing toner motion in the developing time in the first exemplary embodiment.
Figure 9B:
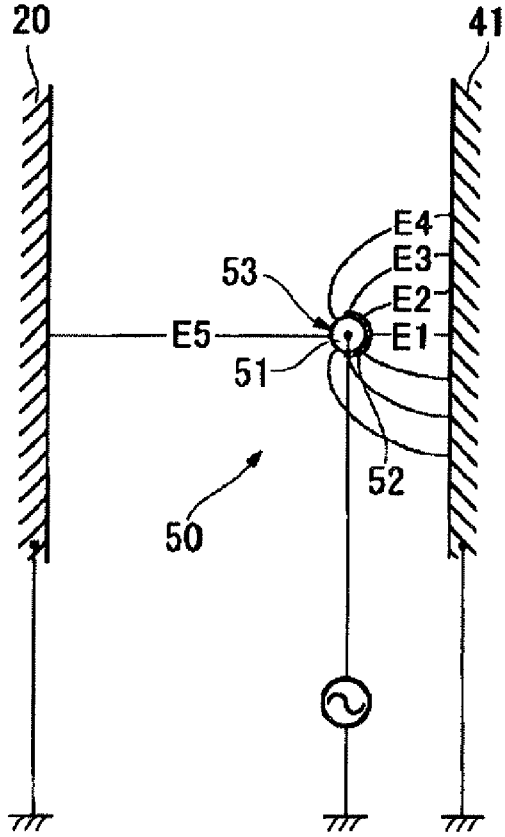

FIG. 9A shows a state of electric lines of force (thin-line portion) in the opposite area between the image carrier 20 and the development roll 41 in the exemplary embodiment, in which a bold dashed line shows an example of a toner flying path on the development roll 41. Further, FIG. 9B shows a partially-enlarged electric lines of force in the FIG. 9A. In FIG. 9A, the insulating coating layer 52 is omitted.

The toner-flying electrode member 50 in the exemplary embodiment is provided with the insulating coating layer 52 which applies continuous insulation coating to the conductive member 51 surface located on the development roll 41 side so as to include, of the conductive member 51, at least the closest area to the development roll 41 and the both side portions which are the most protruding portions facing on the path in which the toner passes from the development roll 41 toward the image carrier 20. Namely, the insulating coating layer 52 is provided for the conductive member 51, including the surface side of the conductive member 51 located on the development roll 41 side and extending to the area over the semicircumference of the conductive member 51.

Under such the circumstances, when an oscillating electric field acts between the toner-flying electrode member 50 (specifically, the conductive member 51) and the development roll 41, the density of electric lines of force also becomes high, and the field intensity in the respective areas has a relation of E1>E2>E3>E4>E5 as shown in FIG. 9B. In the exemplary embodiment, corresponding to areas where the field intensities are E1, E2, and E3, the insulating coating layer 52 is provided. On the other hand, in areas where the field intensities are E4 and E5, the conductive member 51 surface is exposed as it is thereby to form the exposed portion 53. In this exemplary embodiment, there is possibility that the field intensity of each of E1 to E3 is larger than a normal electric field of the used toner.

Whether the corresponding area is an area having possibility that the field intensity is larger than the normal electric field or not may be determined on the basis of for example, the previous experiment or the like, and it is better that its area is set in advance with an allowance in consideration of, for example, an environmental condition and operational assurance for the passage of time.

Under such the structure, the toner on the development roll 41, when reaching the region on which the electric field action by the toner-flying electrode member 50 (specifically, conductive member 51) is exerted, starts flying from the development roll 41. The toner which has flown from the development roll 41, while repeating a reciprocating motion between the development roll 41 and the toner-flying electrode member 5 by the oscillating electric field that is an alternating electric field, comes to go toward the image carrier 20 side. Further, also between the toner-flying electrode member 50 and the image carrier 20, the toner, after reciprocating by the action of the alternating electric field in some degree, finally adheres to an image portion on the image carrier 20. Thereafter, since only the potential of the image portion and the non-image portion on the image carrier 20 side act between the image carrier 20 and the development roll 41, the toner adhering to the image portion on the image carrier keeps a stable state as it is.

Here, since the conductive member 51 of the toner-flying electrode member 50 is provided with the insulating coating layer 52 in response to the area where the field intensity is larger than the normal electric field, the toner in a state where the resistance lowers is prevented from coming into direct contact with the conductive member 51, and the charging state of the toner is kept. Further, in the exposed portion 53 where the insulating coating layer 52 does not exist, the electric field intensities between the conductive member 51 and the development roll 41 and between the conductive member 51 and the image carrier 20 stabilize correspondingly to the nonexistence of the insulating coating layer 52, the stable field action becomes kept there, and unevenness in electric field is reduced. Therefore, the toner which is stable in the charging state flies to the image carrier 20 side, the field action is also stabilized, the density is easy to become uniform in the image portion, and a fog phenomenon produced by toner adhesion to the non-image portion is also suppressed, so that a good image is developed.

Assuming that the insulating coating layer 52 does not exist on the conductive member 51 surface, though stability of the electric field action is obtained, the toner flying from the development roll 41 comes into direct contact with the conductive member 51, remaining in the low-resistance state, whereby the charging state of toner changes. In result, there is fear that change of density in the image portion of the image carrier 20 and the fog phenomenon due to the toner adhesion to the non-image portion are produced.

Further, assuming that the insulating coating layer 52 is provided throughout the entire circumference of the conductive member 51, the change of the toner charging state is suppressed. However, the electric field action is liable to become unstable, and unevenness in electric field is liable to be produced, with the result that there is fear that uniformity of image density, for example, along the rotational axis direction of the image carrier 20 is impaired or the fog phenomenon is produced. Further, by thus providing the insulating coating layer 52, toner accumulation on the insulating coating layer 52 is also liable to be produced by charge accumulation of the insulating coating layer 52 itself, with the result that the unevenness in electric field becomes larger in the area which is small in field intensity.

In the exemplary embodiment, though the insulating coating layer 52 is provided for the area where the field intensity acting between the development roll 41 and the conductive member 51 is larger than the normal electric field, of the conductive member 51 surface, the insulating coating layer 52 may be provided also for a part of the area where the field intensity is equal to or smaller than the normal electric field. Namely, allowance of some degree is provided for the area where the insulating coating layer 52 is provided, whereby the change of the toner charging state is more effectively suppressed, and even in case that the insulating coating layer 52 exists a little in the area where the field intensity is equal to or smaller than the normal electric field, the influence of the unevenness in electric field due to this existence is suppressed, compared with the case where the insulating coating layer 52 is provided throughout the entire circumference of the conductive member 51.

In the exemplary embodiment, though the form in which the charge injection roll 43 and the development roll 41 rotate at the opposite area in the same direction has been described, they may rotate at the opposite area in the opposite directions to each other.

Further, in the exemplary embodiment, though the type in which the charge injection in the toner is performed between the charge injection roll 43 and the development roll 41 has been described, for example, a supply roll which supplies the toner to the development roll 41 side may be used in place of the charge injection roll 43 and a member which performs the charge injection for the toner on the development roll 41 may be provided on a more downstream side in the rotational direction of the development roll 41 than the opposite area between the development roll 41 and this supply roll. Alternatively, for example, another member for charge injection may be provided. In this case, an injection electric field is applied between a roll member which holds and carries the toner and the charge injection member thereby to perform the charge injection in the toner, and thereafter the toner which has been appropriately subjected to the charge injection is anew supplied to the development roll 41.

Further, in the exemplary embodiment, though the roll-shaped development roll 41 and image carrier 20 are shown, the invention is not limited to this, but belt-shaped roll 41 and image carrier 20 may be used.

Second Exemplary Embodiment

Figure 10:
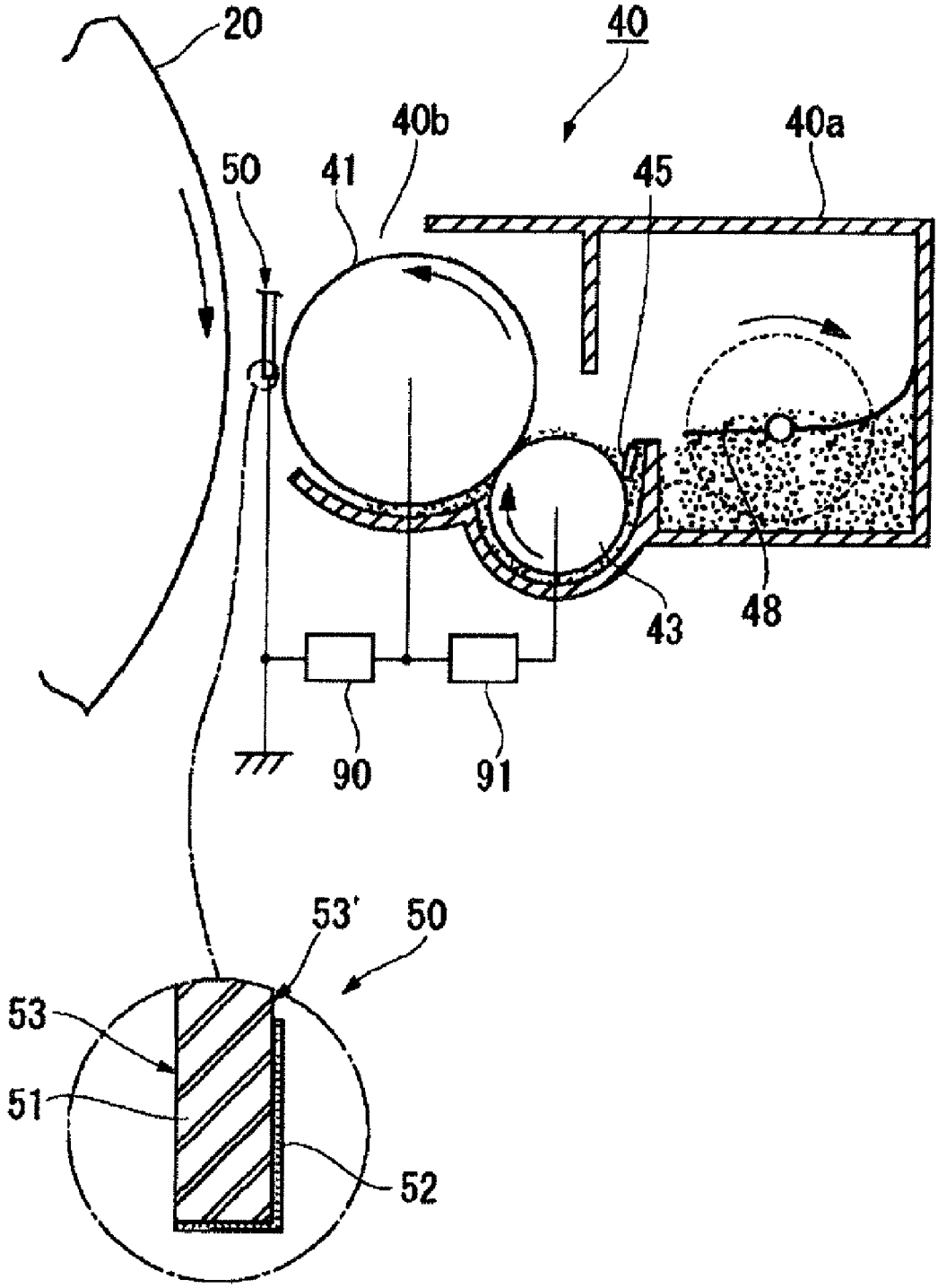
FIG. 10 is an explanatory view showing a developing device in a second exemplary embodiment.

FIG. 10 shows an outline of a developing device 40 in a second exemplary embodiment according to the exemplary embodiment model to which the invention is applied, in which a toner-flying electrode member 50 which is different from the toner-flying electrode member 50 in the first exemplary embodiment is used. Component elements similar to those in the first exemplary embodiment are denoted by the same symbols, and the detailed description of them is omitted here.

In FIG. 10, the toner-flying electrode member 50 in the exemplary embodiment is provided in an opposite area between an image carrier 20 and a development roll 41, extending from the closest area between the image carrier 20 and the development roll 41 to the upstream side in the rotational direction of the development roll 41. Therefore, a gap between the toner-flying electrode member 50 and the development roll 41 is set so as to be gradually decreased toward the downstream side in the rotational direction of the development roll 41. Further, on a surface located on the development roll 41 side of a conductive member 51 of this toner-flying electrode member 50, an insulating coating layer 52 is provided from an end position including an end surface on the downstream side in the rotational direction of the development roll 41 to a part toward the upstream side. A surface located on the image carrier 20 side of the toner-flying electrode member 50 is formed into an exposed portion 53 in which the conductive member 51 is exposed as it is. On the other hand, on a surface located on the development roll 41 side of the toner-flying electrode member 50 and at a part on the upstream side in the rotational direction of the development roll 41, there is provided a second exposed portion 53' in which the insulating coating layer 52 is not provided and the conductive member 51 is exposed as it is.

Further, the toner-flying electrode member 50 in the exemplary embodiment is arranged so that a gap between the toner-flying electrode member 50 and the development roll 41 becomes about 100 μm in a position where a gap between the image carrier 20 and the development roll 41 is 500 μm, and the toner-flying electrode member 50 is supported at both end portions in the rotational axis direction of the development roll 41. The supporting method of the toner-flying electrode member 50 is limited to this. For example, a supporting member which extends along the rotational axis direction of the development roll 41 may be provided for the surface located on the image carrier 20 side of the toner-flying electrode portion 50. In this exemplary embodiment, the peripheral speed of the image carrier 20 is set to 20 mm/s, and the peripheral speed of the development roll 41 is set to 60 mm/s which is larger than the peripheral speed of the image carrier 20.

Further, in the exemplary embodiment, to the development roll 41, a square wave of, for example, 600 Vpp and 15 kHz is applied, and the toner-flying electrode member 50 side (specifically, the conductive member 51) is grounded. Further, an injection electric field generating power source 91 is set so that the charge injection roll 43 side has potential difference of −100V in relation to the development roll 41. The potentials of an image portion and a non-image portion on the image carrier 20 are set similar to those in the first exemplary embodiment.

Toner Motion in Development

Next, toner motion in an opposite area between the image carrier 20 and the development roll 41, which is a feature of the exemplary embodiment, will be described.

Figure 11A:
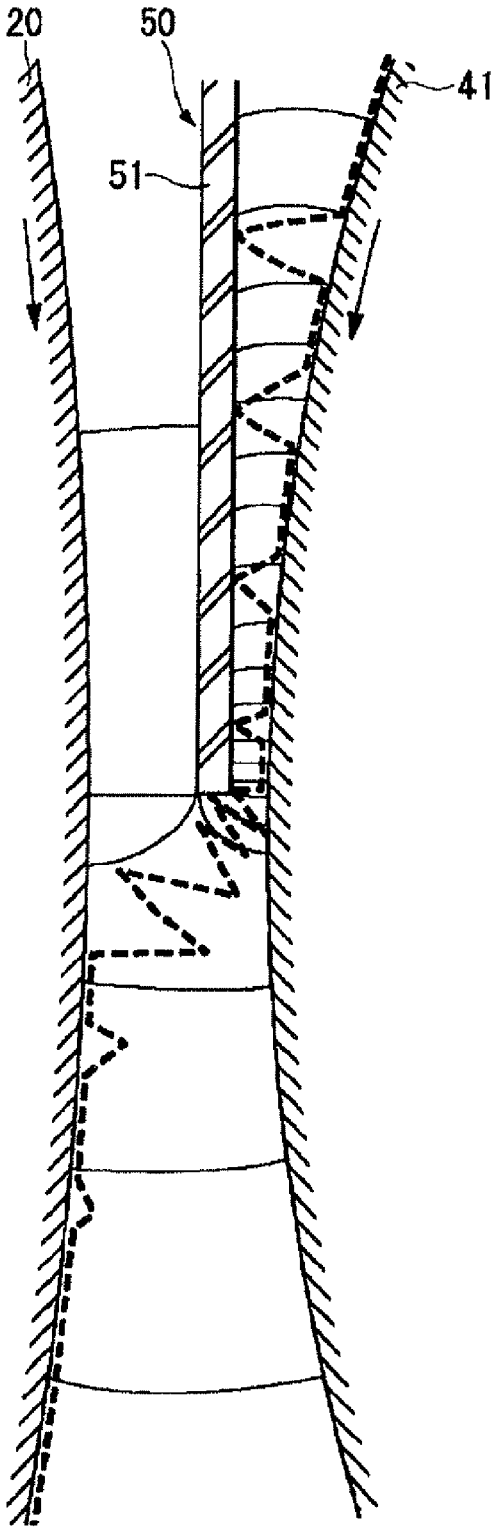
FIGS. 11A and 11B are explanatory views showing toner motion in the developing time in the second exemplary embodiment.
Figure 11B:
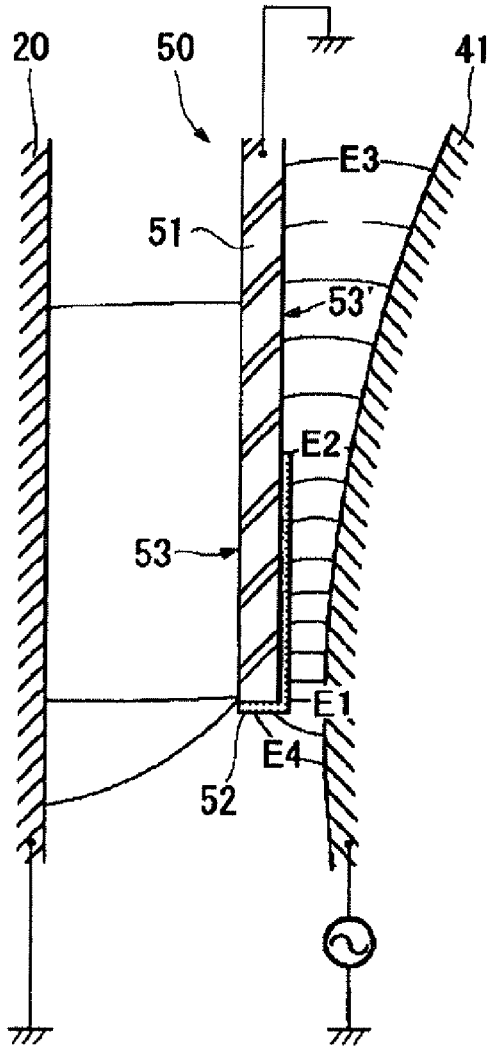

FIG. 11A shows a state of electric lines of force in the opposite area between the image carrier 20 and the development roll 41 in the exemplary embodiment, in which a bold dashed line shows an example of a toner flying path on the development roll 41. Further, FIG. 11B shows partially-enlarged electric lines of force in the FIG. 11A. In FIG. 11A, the insulating coating layer 52 is omitted.

In the exemplary embodiment, the gap between the toner-flying electrode member 50 and the development roll 41 tends to decrease gradually toward the downstream side in the rotational direction of the development roll 41. Therefore, the electric lines of force become narrower in interval toward the downstream side, with the result that the field intensity by the oscillating electric field increases gradually toward a leading end (downstream side end) of the toner-flying electrode member 50, and the field intensity becomes gradually large so as to be $E3<E2<E1$. Further, on the more downstream side than the area where the field intensity is E1, there is also an area (E4) where the electric field action which is large to some degree is exerted between the toner-flying electrode member 50 and the development roll 41.

In the exemplary embodiment, for the conductive member 51 of such the toner-flying electrode member 50, the insulating coating layer 52 is provided at an end surface portion and a part of the surface located on the development roll 41 side. In this exemplary embodiment, in the area corresponding to the electric field intensities of E1 to E2 and E1 to E4, the insulating coating layer 52 is provided. Namely, in the exemplary embodiment, the electric field intensities of E1 to E2 and E1 to E4 exceed the normal electric field of the used toner.

Under such the structure, the toner on the development roll 41, when reaching the region on which the field action by the oscillating electric field between the toner-flying electrode member 50 and the development roll 41 is exerted, starts flying from the development roll 41 (in this exemplary embodiment, flying starts from the area where the gap between the member 50 and the roll 41 becomes about 1 mm). The toner which has flown from the development roll 41, while repeating appropriately a reciprocating motion between the development roll 41 and the toner-flying electrode member 50, goes gradually toward the end of the toner-flying electrode member 50. At this time, with the reciprocating motion of the toner, the toner on the development roll 41 comes to be beaten out in an addition manner, and finally, the amount of toner flying from the development roll 41 becomes larger than that in the constitution in which the linear member is used as in the first exemplary embodiment.

In the end position of the toner-flying electrode member 50, though the toner flies toward the image carrier 20 side from the narrow space between the toner-flying electrode member 50 and the development roll 41, the toner, while somewhat reciprocating between the toner-flying electrode member 50 and the development roll 41 on reception of help of an edge effect of the conductive member 51 because the field intensity of E4 is also large to some degree, goes toward the image carrier 20 side. At this time, since the alternating electric field acts also between the development roll 41 and the image carrier 20, the toner, while repeating slightly the reciprocating motion between the image carrier 20 and the development roll 41, adheres to an image portion of the image carrier 20.

Here, since the toner-flying electrode member 50 is provided with the insulating coating layer 52 in response to the area where the field intensity is larger than the normal electric field, the toner reciprocating between the toner-flying electrode member 50 and the development roll 41 is prevented from coming into direct contact with the conductive member 51 in the state of low resistance. Further, on the conductive member 51 side facing the development roll 41, the second exposed portion 53' where the insulating coating layer 52 does not exist is provided, whereby the electric field action by the oscillating electric field between the conductive member 51 and the development roll 41 is stably performed without unevenness, and the toner flying from the development roll 41 is stabilized satisfactorily. Namely, the toner charging state is stabilized in the end position of the toner-flying electrode member 50, the enough toner flying is secured, and further the toner of which distribution is uniformized more also in the rotational axis direction of the development roll 41 flies toward the image carrier 20. Further, by providing the exposed portion 53 on the conductive member 51 surface located on the image carrier 20 side, the electric field action between the conductive member 51 and the image carrier 20 is also exerted effectively on the toner going from the end position of the toner-flying electrode member 50 toward the image carrier 20 side, an image having the sufficient density is formed in the image portion, and a fog phenomenon produced by toner adhesion to the non-image portion is suppressed, so that a good image is developed.

Assuming that the insulating coating layer 52 is not provided for such the plate-shaped conductive member 51, the toner flying from the development roll 41 comes into direct contact with the conductive member 51, whereby the charging state of toner comes to change. On the other hand, assuming that the insulating coating layer 52 is provided on the entire surface of the conductive member 51, the change of the toner charging state is suppressed. However, stability of the electric field action is impaired, and unevenness of image density in the image portion on the image carrier 20 and the fog phenomenon in the non-image portion are liable to be produced.

Further, in the exemplary embodiment, since the thin insulating coating layer 52 is provided for the conductive member 51, the electric field acting between the development roll 41 and the conductive member 51 is hardly affected by the insulating coating layer 52, and the added oscillating electric field acts almost effectively on the toner. On the other hand, assuming that a thick insulating plate is used in place of the insulating coating layer 52, in case that the distance from the development roll 41 to the insulating plate is not changed, only a part of the added oscillating voltage is useful in oscillating field formation. Further, in case of the thick insulating plate, unevenness in electric field is also liable to be produced, so that it is difficult to secure stable flying of toner.

This point will be understood by modeling the relation between the development roll 41 and the toner-flying electrode member 50 as follows.

When the permittivity of an air layer from the development roll 41 to the insulating coating layer 52 surface is taken as $\epsilon 1$, the thickness thereof is taken as $d_1$, the permittivity of the insulating coating layer 52 is taken as $\epsilon_2$, the thickness thereof is taken as $d_2$, and the area of each layer is taken as S, electrostatic capacitance of each layer is obtained by the following expression:

$$C_1=\epsilon_1 \cdot S/d_1,\ C2=\epsilon_2 \cdot S/d_2.$$

Further, when the voltage between the development roll 41 and the conductive member 51 is V, the voltages applied to the respective layers are $V_1$ and $V_2$ respectively, and the charge stored in the electrostatic capacitance of each layer is Q, the following expression is obtained:

$$V=V_1+V_2=Q/C_1+Q/C_2=(1/C_1+1/C_2)\cdot Q$$

From these expressions, the field intensity $E_1$ of the air layer is obtained by the following expression:

$$E_1=V_1/d_1=V/\{d_1+(\epsilon_1/\epsilon_2)\cdot d_2\}$$

In result, when the thickness $d_1$ of the air layer (corresponding to the distance from the development roll 41 to the insulating coating layer 52) is constant, the smaller $d_2$ is, the smaller $\epsilon_1/\epsilon_2$ is, so that $E_1$ is difficult to be affected. On the other hand, in case that $d_2$ becomes large, $E_1$ is affected and becomes small. Further, in case that $d_2$ is large (the insulating coating layer 52 is thick), unevenness in thickness of $d_2$ becomes also large, and unevenness in $E_1$ by this unevenness in thickness becomes also conspicuous.

In the exemplary embodiment, by providing the insulating coating layer 52 for the conductive member 51, such the disadvantage is reduced.

In the exemplary embodiment, though the toner-flying electrode member 50 is provided so as to extend from the closest area between the image carrier 20 and the development roll 41 to the upstream side in the rotational direction of the development roll 41, it may be provided so as to extend from a position apart from the closest area to the upstream side, or may be provided so as to extend from the more downside side in the rotational direction of the development roll 41 than the closest area to the upstream side. However, it goes without saying that the end position of the toner-flying electrode member 50 on the downstream side in the rotational direction of the development roll 41 is a position where a path in which the toner passes from its end position toward the image carrier 20 side is formed.

In the above-mentioned first exemplary embodiment, as shown in FIG. 9, an alternating electric field is applied to the conductive member 51, and the development roll 41 and the image carrier 20 are grounded. However, as in the second exemplary embodiment (refer to FIG. 11), the alternating electric field may be applied to the development roll 41, and the conductive member 51 and the image carrier 20 may be grounded. In this case, the toner which goes beyond the conductive member 51 toward the image carrier 20 side comes to go toward the image portion of the image carrier 20 by the alternating electric field between the development roll 41 and the image carrier 20, and the electric field which controls development between the image carrier 20 and the development roll 41 becomes an alternating electric field (alternating jumping electric field).

Further, in the above-mentioned second exemplary embodiment, though the alternating electric field is applied to the development roll 41, and the conductive member 51 and the image carrier 20 are grounded, the alternating electric field may be applied to the conductive member 51 as in the first exemplary embodiment, and the development roll 41 and the image carrier 20 may be grounded. In this case, the toner flying from the end portion of the toner-flying electrode member 50 is controlled by the direct electric field between the image carrier 20 and the development roll 41 and development is performed.

Further, in the first exemplary embodiment and the second exemplary embodiment, though the constitution in which the image carrier 20 corresponding to four colors is used in the image forming apparatus is shown, the invention is not limited to this, but the image carrier 20 for a single color may be used.

Further, though the pixel electrode 34 is used in the image carrier 20 in their exemplary embodiments, for example, a photoconductor using no pixel electrode 34 may be used. In this case, even in case that a latent image voltage (latent image potential) on the photoconductor side is set small, a stable image is obtained and the occurrence of fog is also suppressed, so that a long lifetime of the photoconductor itself is realized.

EXAMPLE

Example 1

In the constitution in the first exemplary embodiment, in a state where an image on the image carrier is a non-image portion, charging distributions of toner on the development roll before and after passing through the opposite area between the image carrier and the development roll have been evaluated. As a comparative example, evaluation in case that the insulating coating layer is not provided for the conductive member has been also performed simultaneously. Further, the negatively-charged toner has been used.

Figure 12A:
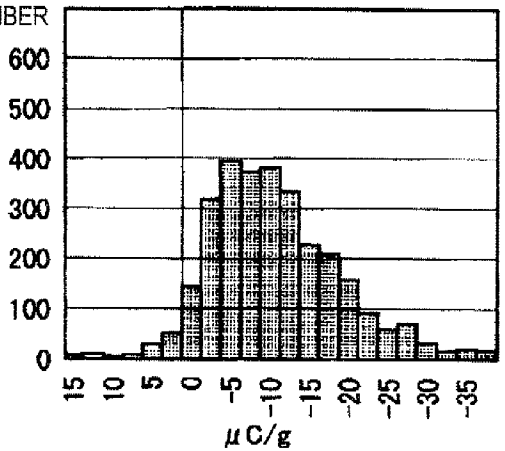
FIGS. 12A and 12B are graphs showing a result in an Example 1.
Figure 12B:
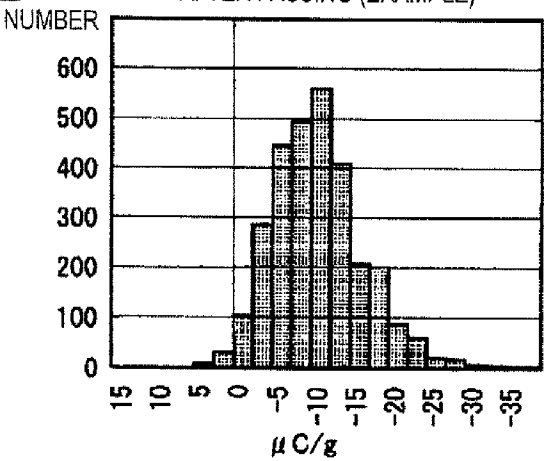
Figure 12C:
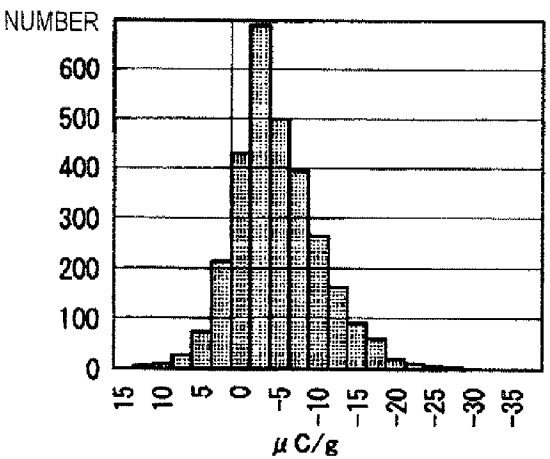
FIG. 12C is a graph showing a result in a comparative example.

FIGS. 12A to 12C are graphs showing results, in which FIG. 12A shows a result before passing, FIG. 12B shows a result after passing, and FIG. 12C shows a result after passing in the comparative example.

These results show a tendency for a distribution rage of the electrification charge to become narrow both in the example and in the comparative example, depending on the passing of the opposite area. Further, in the example, the number of toner having the electrification charge of −5 μC/g is largest before the passing, and the number of toner having the electrification charge of −10 μC/g is largest after the passing. Further, the oppositely-charged toner amount decreases after the passing. However, there is no large change in the whole distribution between before and after the passing, from which it has been understood that change in the charging state is hardly confirmed even in case that the toner comes into contact with the electrode member. On the other hand, in case that the insulating coating layer is not provided, there is a tendency for the electrification charge of the toner after passing through the opposite area to shift in the opposite polarity direction. Specifically, the number of toner having the electrification charge of −2.5 μC/g is largest after the passing, and the amount of the oppositely-charged toner also increases. Namely, it has been understood that provision of the insulating coating layer stabilizes the charging state of toner and no provision thereof changes the charging state of toner by the contact of toner with the conductive member.

Example 2

In the similar constitution to that in the example 1, in case that development on the image carrier has been performed, charging distributions of the toner adhering to the non-image portion and the image portion have been evaluated. As a comparative example, evaluation in case that the insulating coating layer is not provided for the conductive member has been also performed.

FIGS. 13A to 13D are graphs showing results, in which FIG. 13A shows a result in the non-image portion, FIG. 13B shows a result in the image portion, FIG. 13D shows a result in the non-image portion in the comparative example, and FIG. 13D shows a result in the image portion in the comparative example.

Regarding the results in the non-image portion, as shown in FIGS. 13 A and 13C, in the example, toner adhesion has been hardly confirmed in the non-image portion (background portion); but in the comparative example, a large amount of toner adhesion and particularly a large amount of the oppositely-charged toner adhesion have been confirmed.

On the other hand, regarding the results in the image portion, as shown in FIGS. 13 B and 13D in the example, spread of the toner charging distribution has not been confirmed but it has been confirmed that a proper image is obtained, but in the comparative example, it has been confirmed that the charging distribution is wide and even the toner having the opposite polarity is adhering.

From this fact, it has been understood that: in case that development is performed by causing the toner to fly by means of the toner-flying electrode member (in case of toner cloud development), by providing the insulating coating layer for the conductive member, change in the charging state of the toner is suppressed also by the oscillating electric field having the large field intensity, a stable image is obtained, and the occurrence of fog in the background portion is also suppressed. On the other hand, in case that the insulating coating layer is not provided, the toner comes into direct contact with the conductive member by the oscillating electric field, the change in the charging state of the toner is produced, the charging distribution becomes also wider, the oppositely-charged toner is also liable to appear, and the fog also occurs.

Therefore, effectiveness of the invention has been confirmed.

Further, the present inventors, in order to confirm effectiveness of the partial insulating coating layer, have performed an image evaluation in the constitution in which the conductive member surface located on the development roll side is formed into an exposed portion and the conductive member surface located on the image carrier side is provided with the insulating coating layer. In result, unevenness of density has been produced in the image portion and the fog has appeared in the background portion.

Further, when, also in the constitution in the second exemplary embodiment, the similar evaluation to that in the example has been performed, it has been confirmed that the similar results are obtained.

Example 3

In this example, a relation between the voltage applied between the charge injection member and the development roll (corresponding to the voltage for causing injection electric field to act) and the charge amount of the toner which has been subjected to injection-charging (injection charge amount) has been evaluated, in which measurement has been performed at three environmental condition levels of: normal environment (experimental laboratory), high-temperature and high-humidity environment (28° C. 85% RH), and low-temperature and low-humidity environment (10° C. 15% RH). Though the normal environment does not pay attention particularly to the temperature and the humidity, its environment is between the high-temperature and high-humidity environment and the low-temperature and high-humidity environment.

Figure 14:
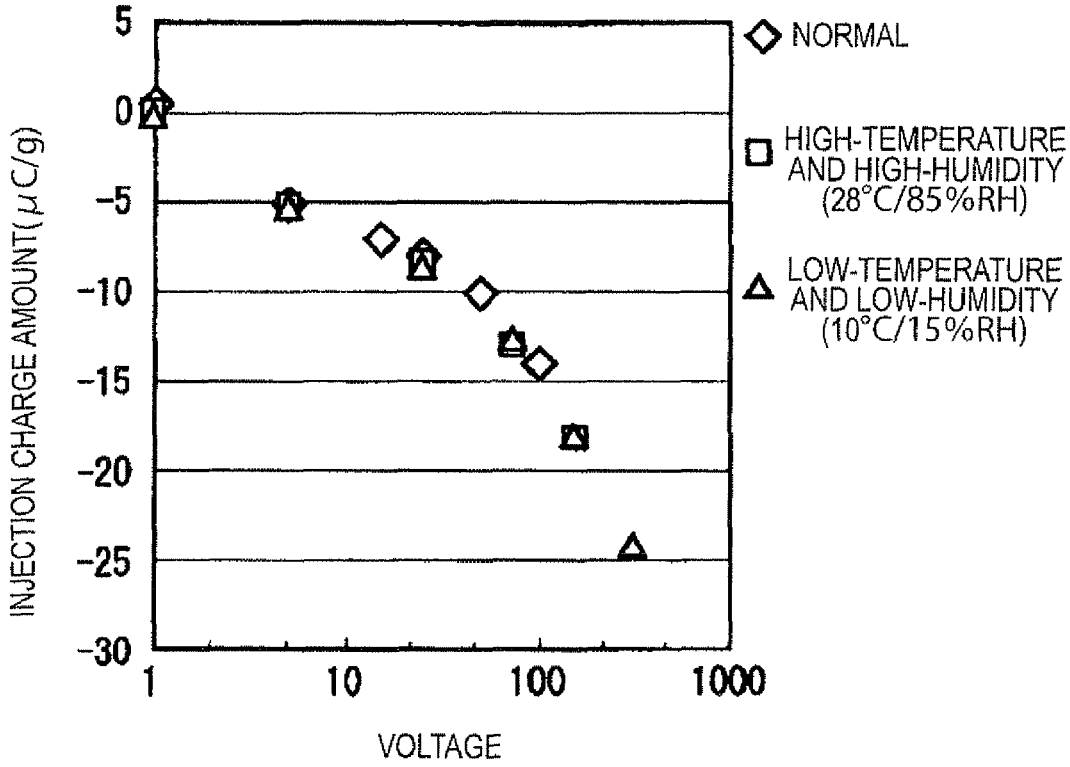
FIG. 14 is a graph showing a result in an Example 3.

As shown in FIG. 14 as a result, it has been confirmed that the injection charge amount increases in response to the applied voltage, regardless of the environmental conditions. This fact indicates that: by subjecting the toner having resistance dependence to injection charging, the injection charge amount is determined by only the applied voltage regardless of the environmental conditions.

Namely, it has been understood that adoption of the injection charging method is excellent in stability for environmental change.

Example 4

In this example, how the toner charging amount changes in response to the environment condition in the injection charging type using the injection charging toner and in the normal charging type using two-component developer (in the triboelectric charging type) has been evaluated.

Figure 15:
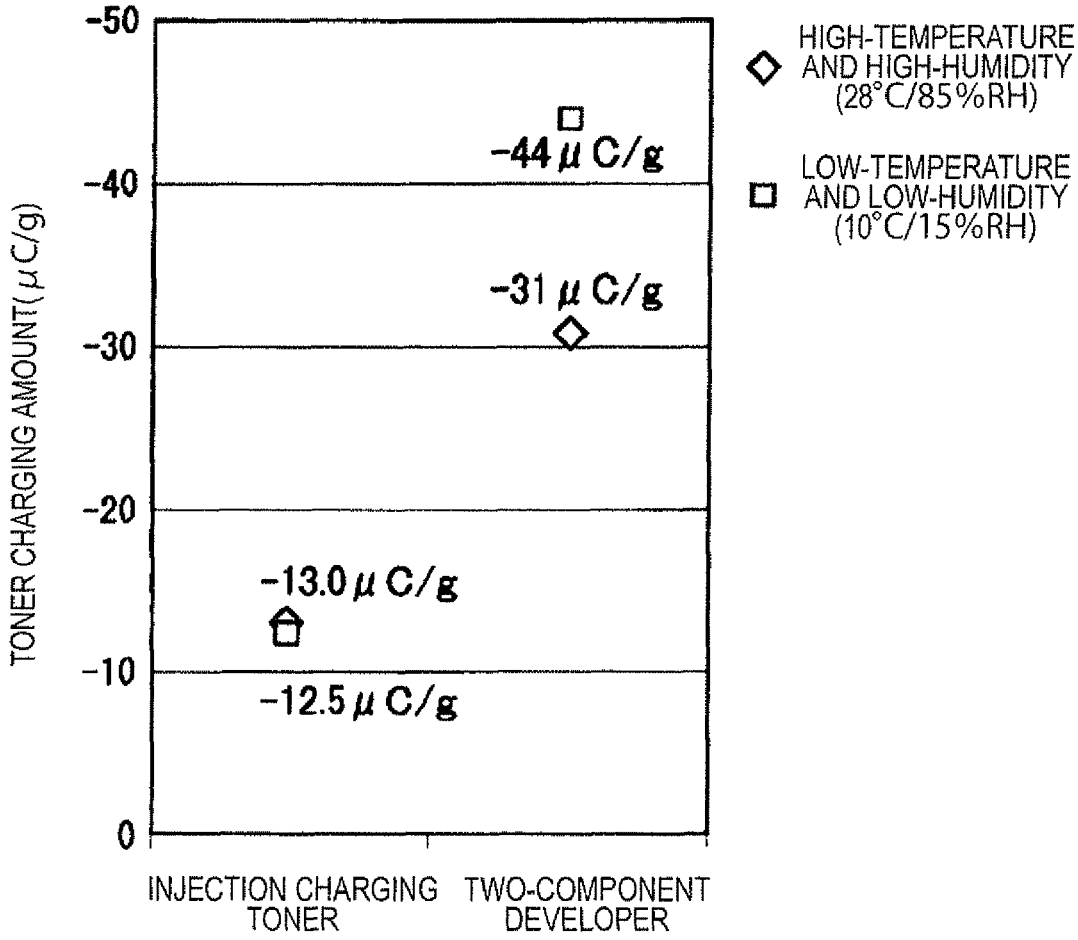
FIG. 15 is a graph showing a result in an Example 4.

As shown in FIG. 15 as a result, in the charging method using the injection charging toner, under the high-temperature and high-humidity environment (28° C. 85% RH), the charging amount is −13.0 μC/g, and under the low-temperature and low-humidity environment (10° C. 15% RH), the charging amount is −12.5 μC/g. On the other hand, in the charging method using the two-component developer, under the high-temperature and high-humidity environment, the charging amount is −44.0 μC/g, and under the low-temperature and low-humidity environment, the charging amount is −31 μC/g.

From this fact, it has been understood: in the method using the injection charging toner, the environmental dependency is hardly confirmed, and the constant charging amount is kept; but in the method using the toner of the triboelectric charging type, a large difference in charging amount between the environmental conditions is confirmed, and this method is high in environmental dependency.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A developing device comprising:

a toner carrier that is arranged oppositely to an image carrier on which an electrostatic latent image is held, and rotates with a toner charged and held on a peripheral surface thereof;

a toner-flying electrode member spaced apart from the toner carrier; and an oscillating electric field generating power source that connects the toner-flying electrode member and the toner carrier, and generates an oscillating electric field which causes the toner to fly from the toner carrier, wherein the toner-flying electrode member includes:

at least one conductive member that extends at least along a rotational axis direction of the toner carrier;

an insulating coating layer that applies insulating coating continuously to a conductive member surface located on a toner carrier side so as to include, of the conductive member, at least the closest area to the toner carrier and the most protruding portion facing on a path in which the toner passes from the toner carrier toward the image carrier; and an exposed portion where the conductive member surface adjacent to the insulating coating layer and located on an image carrier side is exposed.

2. The developing device according to claim 1 in a form where the at least one conductive member is composed of one or plural linear members, wherein the insulating coating layer applies insulating coating to the conductive member surface located on the toner carrier side at least throughout a semi-circumference.

3. The developing device according to claim 1 in a form where the conductive member is a plate member extending along a rotational direction of the toner carrier, wherein the insulating coating layer applies insulating coating to, of the conductive member surface, an end surface facing on a path in which the toner passes from the toner carrier toward the image carrier and a surface located on the toner carrier side.

4. The developing device according to claim 3 in a form where the toner carrier has a curved surface, wherein the insulating coating layer is provided except, of the conductive member surface located on the toner carrier side, a portion corresponding to a region which is located on an upstream side in the rotational direction of the toner carrier, weak in oscillating electric field, and spaced apart from the toner carrier.

5. The developing device according to according to claim 1, further comprising:

a charge injection mechanism that performs charge injection for the toner held on the toner carrier.

6. The developing device according to claim 5, wherein the toner has resistance variation characteristics in which resistance changes sharply in excess of a normal electric field;

the charge injection mechanism performs charge injection for the toner put in a state where the resistance is lowered by an injection electric field having a field intensity exceeding the normal electric field; and the oscillating electric field generating power source sets the oscillating electric field between the normal electric field and the injection electric field.

7. The developing device according to claim 6, wherein the toner-flying electrode member is provided with an insulating coating layer in response to a portion where the field intensity between the toner carrier and the conductive member exceeds the normal electric field.

8. An image forming apparatus including:

an image carrier that rotates with an electrostatic latent image held; and a developing device according to claim 1 that is arranged oppositely to the image carrier.

9. The image forming apparatus according to claim 8 in a form where the conductive member is composed of plural linear members, wherein in the toner-flying electrode member, plural linear members as a conductive member are arranged at the closest area between the image carrier and the toner carrier along the rotational direction of the toner carrier.

10. The image forming apparatus according to claim 8 in a form where the conductive member is a plate-shaped member, wherein in the toner-flying electrode member, the plate-shaped member is arranged nearer the upstream side in the rotational direction of the toner carrier in relation to the closest area between the image carrier and a toner carrier.

11. The image forming apparatus according to according to claim 8, comprising:

an image carrier that has a rotatable support having a circumferential surface larger than the largest image formation area, and pixel electrodes arranged on the rotatable support in matrix for each pixel unit along a rotational direction of the rotatable support and a cross direction crossing to the rotational direction; and a latent image writing unit that applies a latent image voltage based on an image signal to each pixel electrode in a line selected by a scanning signal, of pixel electrode groups in respective lines along the cross direction, thereby to write a latent image.

* * * * *